US006422685B1

(12) United States Patent
Kondo et al.

(10) Patent No.: US 6,422,685 B1
(45) Date of Patent: Jul. 23, 2002

(54) DRIVING CIRCUIT FOR ACOUSTIC PRINTER AND ACOUSTIC PRINTER USING THE SAME

(75) Inventors: Yoshinao Kondo, Ebina; Kunihiro Takahashi, Fujisawa; Naoki Morita, Tokyo; Nanao Inoue, Kawasaki, all of (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/722,451

(22) Filed: Nov. 28, 2000

(30) Foreign Application Priority Data

May 16, 2000 (JP) ..... 2000-143951
Oct. 10, 2000 (JP) ..... 2000-309876

(51) Int. Cl.[7] ..... B41J 2/135
(52) U.S. Cl. ..... 347/46
(58) Field of Search ..... 347/46, 11, 10, 347/68; 310/317, 323

(56) References Cited

U.S. PATENT DOCUMENTS 4,535,346 A * 8/1985 Lichti ..... 347/10
5,191,354 A 3/1993 Quate ..... 346/1.1
5,268,610 A * 12/1993 Hadimioglu et al. ..... 310/323
5,589,864 A 12/1996 Hadimioglu ..... 347/46
6,040,827 A * 3/2000 Shiina et al. ..... 345/208
6,260,959 B1 * 7/2001 Takahashi ..... 347/68

FOREIGN PATENT DOCUMENTS

| | | |
|---|---|---|
| JP | 63-166545 | 7/1988 |
| JP | 01-172211 | 7/1989 |
| JP | 5-278218 | 10/1993 |
| JP | 8-187853 | 7/1996 |
| JP | 8-290587 | 11/1996 |

* cited by examiner

*Primary Examiner*—John Barlow
*Assistant Examiner*—Ly T Tran
(74) *Attorney, Agent, or Firm*—Morgan, Lewis & Bockius LLP

(57) ABSTRACT

A driving circuit for an acoustic printer and an acoustic printer which enables high speed and high image quality recording and is reduced in size and cost. An inductance switching circuit connected in parallel to an electrostatic capacity included in a piezoelectric element is connected to an amplifying part. The inductance switching circuit and the electrostatic capacity form a parallel resonance circuit called TANK circuit. The inductance switching circuit is formed by two inductances and switches connected in series to the respective inductances, and the inductances are connected in parallel. The switches are externally controllable.

9 Claims, 15 Drawing Sheets

DRIVING CIRCUIT FOR ACOUSTIC PRINTER AND ACOUSTIC PRINTER USING THE SAME

BACKGROUND OF THE INVENTION

1. Field of the Invention

This invention relates to a driving circuit for an acoustic printer and an acoustic printer, and particularly to the driving circuit of an acoustic printer and the acoustic printer for realizing high speed operation and high image quality.

2. Description of the Related Art

As an apparatus for recording an image by making ink liquid into small grains (so-called liquid drop) and flying the same on a recording medium to form a dot, an ink jet printer has been put to practical use heretofore. A known acoustic printer uses the operation of an acoustic transducer in a device for flying the liquid drop on the recording medium.

As an example, Japanese Patent Application Laid Open No. 5-278218 corresponding to U.S. Pat. No. 5,191,354 discloses a technique. The acoustic printer using an acoustic transducer is adapted to produce periodic perturbation on the free surface of liquid ink with a suitable excitation frequency. When the amplitude of vibration pressure is equal to or higher than the critical rise amplitude level, one or more standing capillary waves are generated on the free surface of liquid ink, thereby flying a liquid drop on the recording medium. To produce such perturbation, the transducer is connected to a driver to be driven.

Further, Japanese Patent Application Laid Open No. 8-187853 corresponding to U.S. Pat. No. 5,589,864 discloses a technique where a piezoelectric device driven by an RF signal is used as a transducer. In this technique, a PIN diode or a varactor is connected in series to the piezoelectric device, and in the case of the varactor, the impedance is changed to switch on and off the RF signal, thereby controlling ink injection.

To control the RF signal, the applicant of the invention has proposed a technique (Japanese Patent Application Laid Open No. 11-72211) of generating an a.c. signal in a piezoelectric element without an a.c. signal source concerning the RF-controller and the RF driving circuit. In this technique, the inductance connected in parallel to the piezoelectric element constitutes a parallel resonance circuit, and electric charges from charge storage means and energy based on the resonance circuit are alternately supplied by switching means to discharge ink, so that it is not necessary to always supply an a.c. signal so as to reduce power consumption.

Generally, to obtain a print image of high image quality in a printer, improvement in resolution and gradient is demanded. In the acoustic printer, the resolution can be improved by making an ink drop minute, and the gradient can be improved by increasing or decreasing the diameter of an ink drop or superposing minute ink.

Concerning the improvement in resolution, there is direct proportionality between the wavelength of an ultrasonic wave propagating through an ink chamber filled with ink and the discharged ink drop, and the size of an ink drop can be varied by controlling the wavelength of an ultrasonic wave. Thus, the resolution can be improved.

Concerning the improvement in gradient, there have been proposed a technique where the frequency/amplitude/duration of the RF signal is changed to obtain ink drops different in diameter and a technique where plural ink drops discharged by starting the piezoelectric element plural times are superposed on the same pixel on a recording medium. Japanese Patent Application Laid Open No. 8-290587 discloses a technique where an ink drop group continuously discharged by one drive of the piezoelectric element is superposed On the same pixel on a recording medium.

The technique of superposition recording plural or one group of ink drops, however, has the problem that essentially the print speed is lowered.

For example, in the conventional superposition recording, the dot diameter after superposition is calculated by the following expression.

(Dot diameter of superposition)=(Unit dot diameter)×(The one third power of superposition frequency)

Accordingly, to obtain double dot diameter, the discharge time for eight times is required. Japanese Patent Application Laid Open No. 8-290587 discloses:

(Time for obtaining N-number of ink drop groups)<N×(Time for obtaining one ink drop), however, at least the time 1.2 or more times as much as the time for obtaining one ink drop is required for obtaining two ink drop groups.

Then the technology for changing the size of an ink drop by RF frequency is desired to realize high speed and high image quality recording. However, in the conventional technology for changing the size of an ink drop, the driving mode of the piezoelectric element needs a high output RF amplifier. Therefore, the cost is increased and the apparatus is increased in size.

As another driving mode of the piezoelectric element, the applicant of the invention has proposed the technology disclosed in Japanese Patent Application Laid Open No. 11-72211. In the technology disclosed in Japanese Patent Application Laid Open No. 11-72211, the driving circuit can be reduced in size and the cost of the apparatus can be held down to the lowest by adopting TANK circuit where an inductance and a capacity component of a piezoelectric element constitute a parallel resonance circuit.

The TANK circuit, however, has the problem that the resonance frequency is single and the gain is remarkably lowered for a different RF frequency so that sometimes an ink drop can not be discharged.

SUMMARY OF THE INVENTION

The present invention has been proposed in view of the above circumstances and an object of the present invention is to provide a driving circuit for an acoustic printer which enables high speed and high image quality recording and reduction of size and cost.

Other object of the present invention is to provide an acoustic printer using a driving circuit.

The first aspect of the present invention is a driving circuit for an acoustic printer adapted to form an image on a recording medium by an ejector for discharging stored ink by an ultrasonic wave generated from a piezoelectric element in response to the supply of an a.c. signal. The driving circuit comprises a resonance circuit which includes an inductance connected in parallel to the piezoelectric element, has a plurality of predetermined resonance frequencies, and is set to one resonance frequency among the plural resonance frequencies; and setting means for setting the resonance frequency of the resonance circuit.

According to the first aspect of the present invention, the resonance circuit includes the inductance connected in parallel to the piezoelectric element, and a parallel resonance circuit (so-called TANK circuit) is constituted by the capacity component contained in the piezoelectric element and the inductance. In this arrangement, according to a supplied designated a.c. signal, an a.c. signal on a resonance frequency in the parallel resonance circuit is output. When the signal on the resonance frequency is input to the piezoelectric element, the ultrasonic waves are generated from the piezoelectric element and stored ink is discharged from an ejector to form an image on a recording medium.

In this aspect, the resonance circuit has plural resonance frequencies, and the plural resonance frequencies are set by setting means, whereby the resonance frequency of the resonance circuit is changed, the frequency of an a.c. signal supplied to the piezoelectric element is changed, and the frequency for driving stored ink is changed. Accordingly, the size of an ink drop discharged above the critical point of surface tension of ink is changed. In other words, the resonance frequency of the resonance circuit is set by the setting means to control the size of an ink drop discharged from an ejector.

That is, the resolution can be improved by controlling the size of the ink drop and also the gradient can be improved. Since an image is recorded by changing the frequency of an a.c. signal supplied to the piezoelectric element, an image can be recorded with good image quality without superposition of dots so as to record an image at high speed.

Furthermore, since the driving circuit of an acoustic printer adopts the tank circuit comprising a parallel resonance circuit thus formed by the inductance and the capacity component contained in the piezoelectric element, the driving circuit of the acoustic printer can be reduced in size and the cost of the apparatus can be held down.

The second aspect of the present invention is a driving circuit for an acoustic printer according to the first aspect, wherein the resonance circuit includes inductance means which can be set to one inductance among a plurality of predetermined inductances, and the setting means is adapted to set the resonance frequency by setting the inductance of the inductance means.

According to the second aspect of the present invention, the resonance circuit includes inductance means which can be set to one inductance among a plurality of predetermined inductances, and the inductance of the inductance means is set by the setting means to set one of plural resonance frequencies.

The inductance means is formed by plural inductance elements different in inductance and switching means for switching one of the plural inductance elements. The setting means may be constituted to force the switching means to switch one inductance element. The inductance is thus selectively switched to easily vary the ink drop size.

Concrete setting of inductance in the inductance means and setting means may be performed by switch means controllable from the outside. For example, plural serially connected inductance and switch means are used to be respectively connected in parallel to each other and connected in parallel to the piezoelectric element, and the respective switch means is controlled externally to change the resonance frequency. In this case, as switching means, a transistor element not grounded may be used.

The third aspect of the present invention is a driving circuit for an acoustic printer of the first or second aspect of the present invention, wherein the setting means is adapted to set the plural resonance frequencies according to image data expressing an image formed on the recording medium.

According to the third aspect of the present invention, the setting means controls setting of plural resonance frequencies according to the image data (e.g. characters, lines, photo images or the like) expressing an image formed on the recording medium to enable high speed and high image quality recording according to the image.

For example, according to the image data expressing an image formed on a recording medium, plural inductances of the inductance means described in the second aspect are set to output ink of an ink drop size (dot size) depending on the resonance frequency varying with the inductance from an ejector. That is, the dot size is varied to enable high speed and high image quality recording according to an image.

The invention described in the fourth aspect of the present invention is a driving circuit for an acoustic printer adapted to form an image on a recording medium by an ejector for discharging stored ink by ultrasonic waves generated from a piezoelectric element. The driving circuit comprises generating means for generating a positive polarity pulse signal on a designated frequency for generating an a.c. signal supplied to the piezoelectric element and a negative polarity pulse signal complementary with the positive polarity pulse signal; selecting means for selecting at lease one of the positive polarity pulse signal and the negative polarity pulse signal; and a.c. signal generating means for generating an a.c. signal to be supplied to the piezoelectric element according to the pulse signal selected by the selecting means.

According to the fourth aspect of the present invention, the generating means generates a positive polarity pulse signal with a designated frequency for generating an a.c. signal supplied to the piezoelectric element and a negative polarity pulse signal complementary with the positive polarity pulse signal. The selecting means selects at least one of the positive polarity pulse signal and the complementary negative polarity pulse signal generated by the generating means, and according to the selected pulse signal, an a.c. signal supplied to the piezoelectric element is generated by the a.c. signal generating means. Thus, at least one of the positive polarity pulse signal and the complementary negative polarity pulse signal is selected by the selecting means and an a.c. signal is generated according to the selected pulse signal, but in the case where the positive polarity pulse signal and the complementary negative polarity pulse signal are selected, the respective pulse signals are composed, and according to the composite pulse signal, an a.c. signal is generated by the a.c. signal generating means. That is, the positive polarity pulse signal and the complementary negative polarity pulse signal are composed so that the composite pulse signal is a different pulse signal different in frequency from the positive polarity pulse signal or the complementary negative polarity pulse signal, and a.c. signals with different frequencies can be generated depending on the case of selecting the positive polarity pulse signal and the complementary negative polarity pulse signal and the case of selecting one pulse signal of them. Accordingly, plural a.c. signals different in frequency can be generated by the selecting means and the a.c. signal generating means.

The positive polarity pulse signal or the complementary negative polarity pulse signal may be pulse signals which have the same period and phase difference, or pulse signals having different periods. When the period is different, the phase difference is independent directly, but it is desirable that the rising and the falling of the signal agree with each other at the starting point in the case of deciding to start.

Ultrasonic waves are generated from the piezoelectric element by supplying an a.c. signal generated by the a.c.

signal generating means to the piezoelectric element and stored ink is discharge by the ejector to form an image on the recording medium. At this time, a.c. signals with different frequencies can be generated by the selecting means and the a.c. signal generating means so that the frequency of an ultrasonic wave generated from the piezoelectric element can be changed and the frequency of vibrating stored ink can be changed. That is, the size of an ink drop discharged on exceeding the critical point of surface tension of ink can be changed.

Accordingly, the size of an ink drop discharged from the ejector can be controlled by the selecting means and the a.c. signal generating means. That is, the size of an ink drop is thus controlled so that the resolution can be improved and also the gradient can be improved. Further, since an image is recorded by changing the frequency supplied to the piezoelectric element, an image can be recorded with good image quality without superposition of dots and image recording can be performed at high speed. The frequency of an a.c. signal can be selectively switched so that the size of an ink drop can be easily changed.

The selecting means selects one of the positive polarity pulse signal and the negative polarity pulse signal, whereby an a.c. signal with the main frequency can be generated. For example, between the positive polarity pulse signal and the negative polarity pulse signal complementary with the positive polarity pulse signal, one signal with the duty ratio of substantially 50% is selected to generate an a.c. signal with the main frequency among the plural signals different in frequency.

On the other hand, the selecting means selects both of the positive polarity pulse signal and the negative polarity pulse signal, whereby an a.c. signal with the sub-frequency can be generated. For example, a positive polarity pulse signal and a negative polarity pulse signal with the duty ratio of substantially 25 with the phase shift of π□ are selected to generate an a.c. signal with the sub-frequency among the plural signals different in frequency. In the above examples, the sub-frequency is lower than the main frequency.

The fifth aspect of the present invention is a driving circuit according to the fourth aspect, wherein the selecting means is adapted to perform the selection according to image data expressing an image formed on a recording medium.

According to the fifth aspect of the present invention, the selecting means described in the fourth aspect selects at least one of the positive polarity pulse signal and the complementary negative polarity pulse signal according to image data (e.g. characters, lines, photo images or the like) expressing an image formed on the recording medium, whereby the frequency of an a.c. signal supplied to the piezoelectric element can be controlled to output ink of an ink drop size (dot size) according to the frequency of the a.c. signal supplied to the piezoelectric element from the ejector. That is, the dot size is varied to enable high speed and high image recording according to the image.

The sixth aspect of the present invention is an acoustic printer which is equipped with the driving circuit of an acoustic printer described in at least one of the first, second or third aspect to provide a high speed high image quality, small-sized and low-cost acoustic printer.

The seventh aspect of the present invention is an acoustic printer which is equipped with the driving circuit of an acoustic printer described in at least one of the fourth or sixth aspect to provide a high speed high image quality, small-sized and low-cost acoustic printer.

DETAILED DESCRIPTION OF THE PREFERRED EMBODIMENTS

Embodiments of the invention will now be described in detail with reference to the attached drawings.

Figure 2:
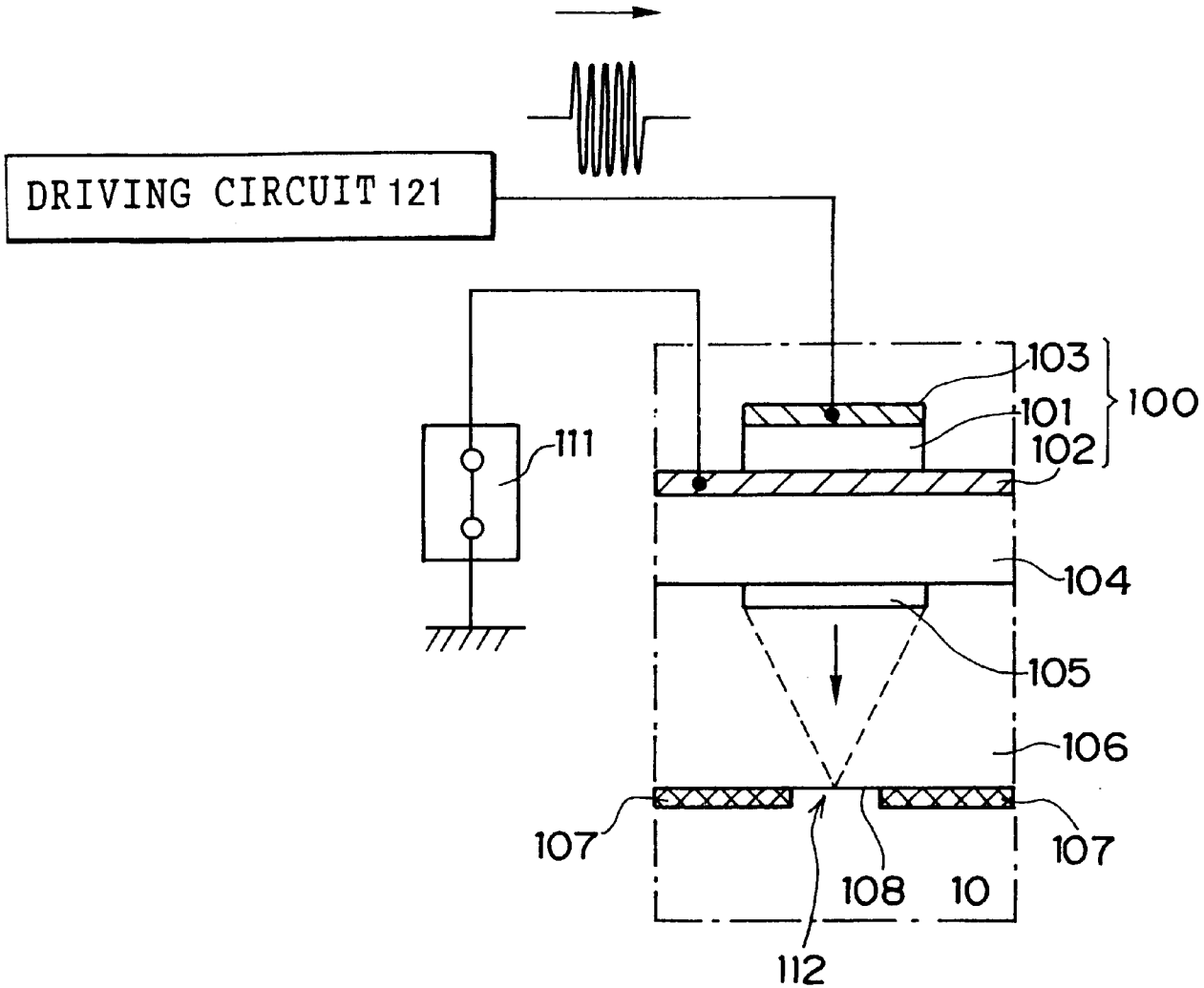
FIG. 2 is a conceptual view showing the configuration of an acoustic printer.

FIG. 2 is a conceptual drawing of an ejector of an acoustic printer according to the embodiment. The ejector 10 includes one piezoelectric element 100 formed by a first electrode 102 installed on one face of a substrate 104, a second electrode 103 connected to a driving circuit 121 for driving the ejector 10, and a piezoelectric body 101 sandwiched between the first electrode 102 and the second electrode 103.

Further, an acoustic lens 105 is installed on the other face of the substrate 104 of the ejector 10, and ultrasonic waves generated by the piezoelectric element 100 are focused on an ink discharge opening 112 of a liquid level control plate 107 through an ink chamber 106 filled with ink by the acoustic lens 105.

The respective centers of the piezoelectric element 100, the acoustic lens 105, and the ink discharge opening 112 are arranged on one straight line. Ink filled in the ink chamber 106 is held by application of negative pressure to the ink chamber 106, thereby preventing leakage of ink liquid from the ink discharge opening 112.

A plurality of the thus constructed ejectors 10 is arranged in designated positions in one print head.

Among the plural ejectors 10, a desired ejector 10 is selected by grounding the first electrode 102 through an externally controllable select switch 111, and an RF signal output from the driving circuit 121 is input to the second electrode 103. The signal is converted to an ultrasonic wave by the piezoelectric element 100, and the generated ultrasonic wave is focused and damped in the ink chamber 106 through the acoustic lens 105 to reach the liquid level control plate 107 which is a ink liquid level. Then an ink drop is discharged from the ink discharge opening 112.

Figure 3:
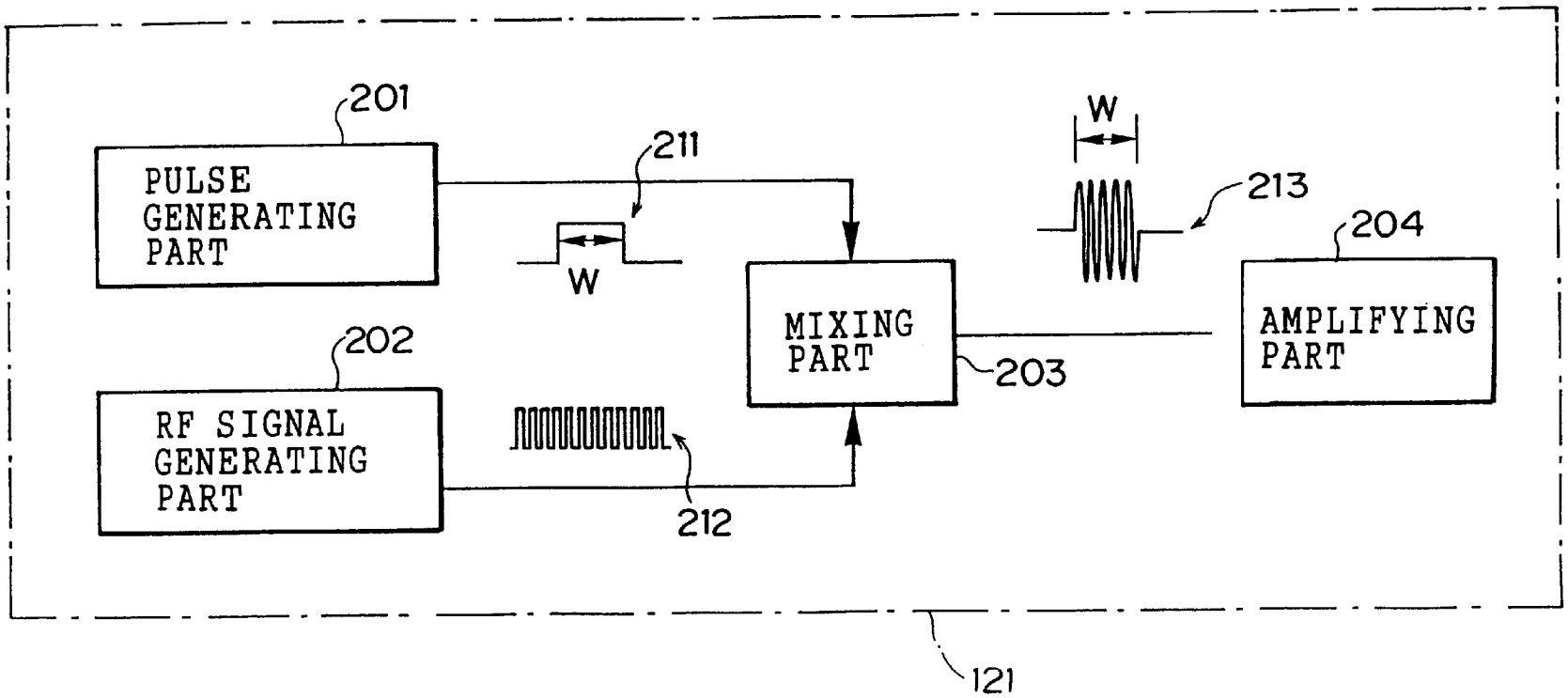
FIG. 3 is a block diagram showing the schematic configuration of the first embodiment of a driving circuit.

First Embodiment:

A first embodiment of a driving circuit 121 will now be described in detail. FIG. 3 shows the internal configuration of the driving circuit 121 according to the first embodiment, and as shown in FIG. 3, the driving circuit 121 includes a pulse generating part 201 for generating a designated pulse, an RF signal generating part 202 for generating a designated a.c. signal (RF signal), a mixing part 203 for composing signals from the pulse generating part 201 and the RF signal generating part 202, and an amplifying part 204 for amplifying a composite signal output from the mixing part 203. An RF signal 212 with a designated frequency F generated by the RF signal generating part 202 and a pulse 211 with a designated pulse width W generated by the pulse generating part 201 are composed in the mixing part 203 to become a burst wave 213 of a length W with RF frequency F, which is amplified by the amplifying part 204.

Figure 4:
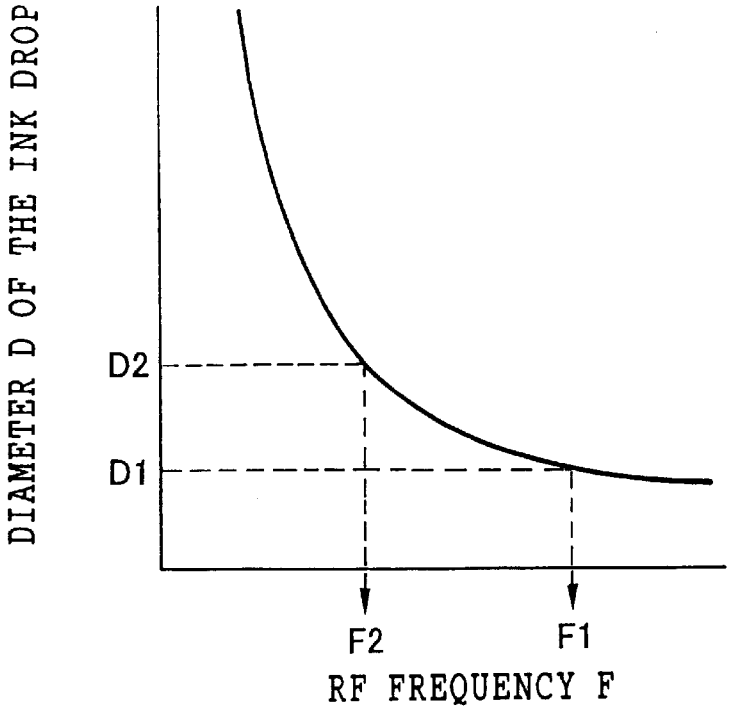
FIG. 4 is a diagram showing the relationship between the RF frequency and the diameter D of an ink drop.

There is direct proportionality between the wavelength of an ultrasonic wave propagating through the ink chamber and the diameter of an ink drop. Since the frequency of an ultrasonic wave converted by the piezoelectric element 100 is equal to the RF frequency, inversely proportional relationship is established between the RF frequency F and the wavelength of an ultrasonic wave. Accordingly, the RF frequency and the diameter D of the ink drop are, as shown in FIG. 4, inversely proportional to each other. For example, in FIG. 4, supposing that the relationship expressed by:

$$F2=(½)\times F1 \quad (1)$$

is established between two different RF frequencies F1 and F2, the relationship expressed by:

$$D2=2\times D1 \quad (2)$$

is established between the diameters D1 and D2 of the ink drops corresponding thereto.

Further, concerning the relationship between the diameter D of a discharged ink drop and the dot diameter formed on the recording medium, it is known up to now that experimentally the direct proportionality is established. That is, in the expression (2), it means that supposing that an ink drop with a diameter D2 forms a dot with 600 dpi on the recording medium, a dot with 1200 dpi is formed on the recording medium by an ink drop with a diameter D1.

Further, it is confirmed by experiments up to now that the time required for a series of processes related to ink drop discharge, that is, meniscus generation, ink drop discharge and meniscus annihilation and the like can be controlled to be constant regardless of the diameter of the ink drop.

Thus, in the case where the diameter D of the ink drop discharged from the same ink discharge opening can be controlled by changing the RF frequency, the gradient of the acoustic printer can be secured while lowering of the print speed is restrained.

Figure 1:
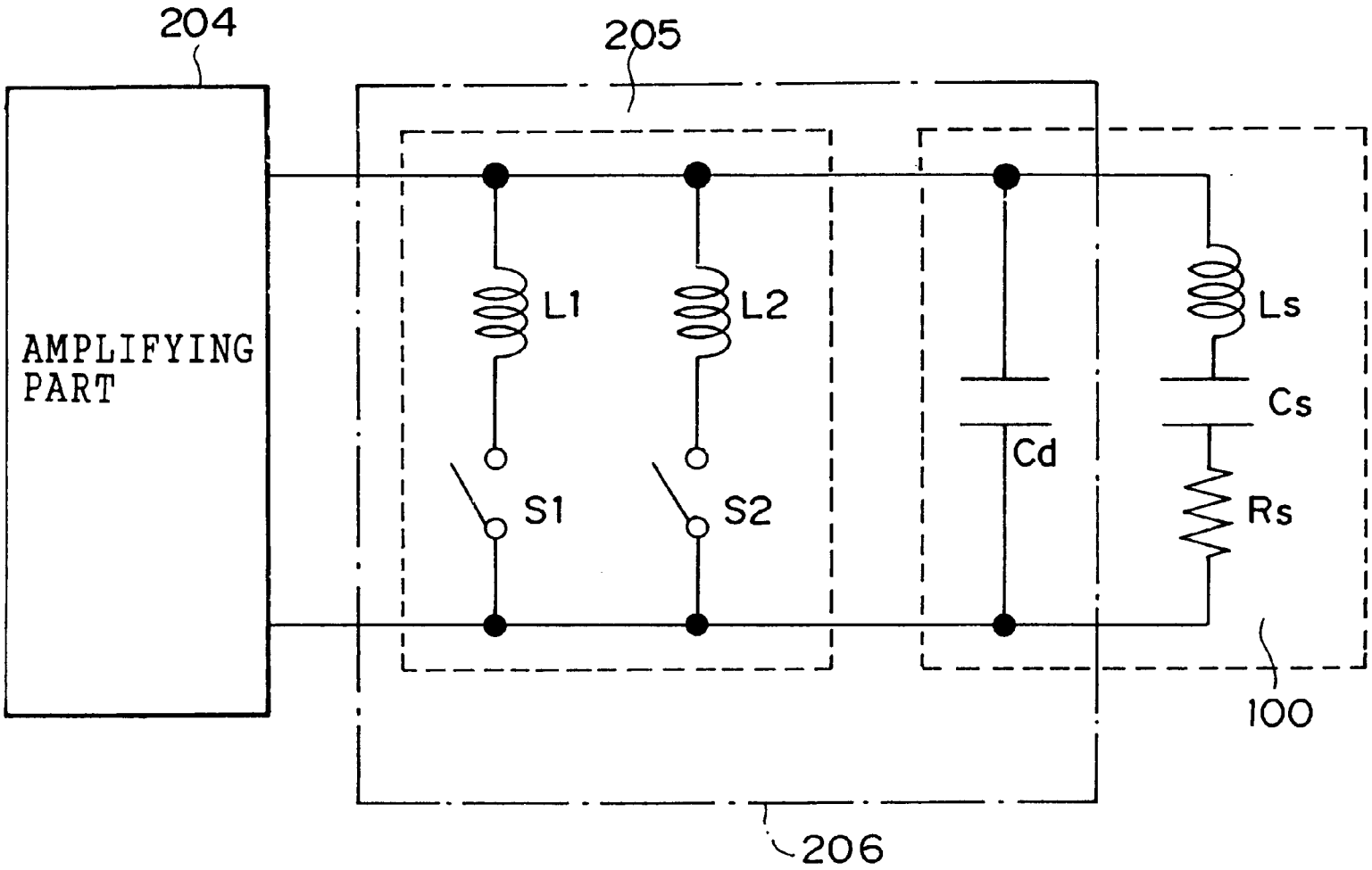
FIG. 1 is a conceptual view showing the configuration of an output stage of a first embodiment of a driving circuit of the present invention.

Then, in the present embodiment, the vicinity of the output stage in the driving circuit 121 is constituted as shown in FIG. 1. FIG. 1 is a conceptual drawing of the vicinity of the output stage of the driving circuit 121 related to the first embodiment. In here, concerning the case of transmitting two different RF frequencies F1 and F2 to the piezoelectric element 100, the driving circuit 121 in the embodiment will now be described further in detail. In FIG. 1, the piezoelectric element 100 is designated as an equivalent circuit where a series resonance circuit of an inductance Ls, a capacitor Cs and a resistor Rs is connected in parallel to a capacitor Cd.

An inductance switching circuit 205 connected in parallel to an electrostatic capacity Cd included in the piezoelectric element 100 is connected to the amplifying part 204. An inductance switching circuit 205 and the electrostatic capacity Cd form a parallel resonance circuit called TANK circuit 206. The inductance switching circuit 205 is formed by two inductances L1 and L2 and switched S1 and S2 connected in series to the respective inductances L1 and L2, and the inductances L1 and L2 are connected in parallel. The switches S1 and S2 can be controlled from the outside.

In the inductances L1 and L2 of the inductance switching circuit 205, the switches S1 and S2 are on-off controlled according to the respective signals from the outside, and in the case where the switches S1 and S2 both are on, the resonance frequency f1 of the TANK circuit 206 is:

$$f1=1/\{2\pi\sqrt{([L1//L2]\times Cd)}\} \quad (3),$$

wherein [L1//L2] indicates parallel composite inductance.

On the other hand, in the case where the switch S1 is off and the switch S2 is on, the resonance frequency f2 of the TANK circuit 206 is:

$$f2=1/\{2\pi\sqrt{(L2\times Cd)}\} \quad (4).$$

That is, the expressions (3) and (4) are plural different resonance frequencies of the TANK circuit 206, and the resonance frequency can be selected by external control.

The relationship expressed by:

$$L2>[L1//L2] \quad (5)$$

is established between the inductance L2 and the parallel composite inductance [L1//L2].

Moreover, the relationship expressed by:

$$f1>f2 \quad (6)$$

is established between the resonance frequencies f1 and f2 of the TANK circuit 206. Accordingly, the inductances L1 and L2 such that RF frequencies F1 and F2 and the frequencies f1 and f2 of the TANK circuit 206 are equal to each other are determined.

Figure 5:
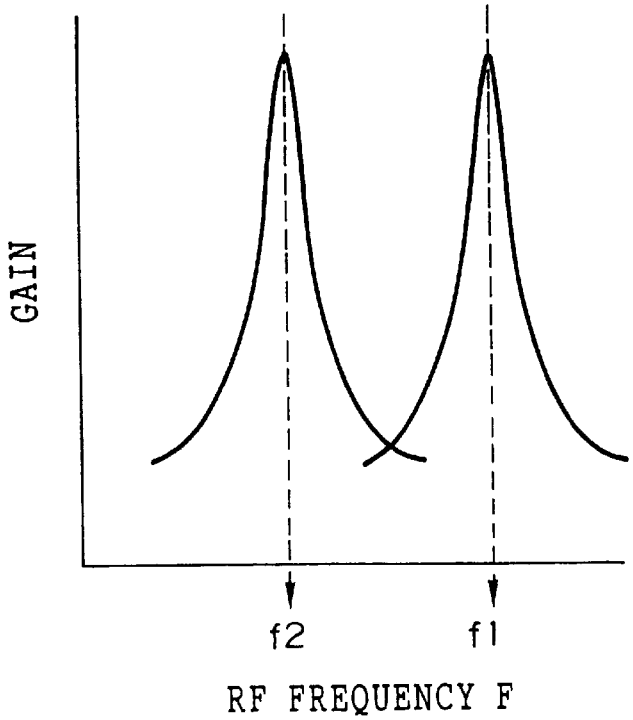
FIG. 5 is a diagram showing the transfer characteristics of a TANK circuit.

FIG. 5 shows the transfer characteristic of the TANK circuit 206. The TANK circuit has steep characteristic about the resonance frequencies f1 and f2. Accordingly, when the frequency F of the input RF signal is shifted from the selected resonance frequency f, the gain suddenly falls so that electric power enough to generate an ink drop can not be secured. In other words, it is possible to generate an ink drop by signals with the resonance frequencies f1 and f2.

The operation of the thus constructed driving circuit 121 according to the first embodiment will now be described in accordance with FIGS. 1 and 3.

A pulse 211 with a designated pulse width W is generated by the pulse generating part 201 and the pulse and an RF signal 212 generated by the RF signal generating part 202 are composed by the mixing part 203 to generate a burst wave 213 of a length W with the RF frequency F. The burst wave 213 is amplified by the amplifying part 204 and input to the TANK circuit 206. At this time, according to the kind (e.g. characters, lines and images) of the input image data, the pulse width W generated by the pulse generating part 201 is changed to vary the RF frequency RF of the burst wave 213 input to the TANK circuit 206.

In the TANK circuit 206, similarly, according to the kind of the input image data, the switches S1 and S2 are on off controlled. That is, according to the RF frequency, the switches S1 and S2 are controlled. Accordingly, the resonance frequency f of the TANK circuit 206 is varied.

In the first embodiment, the RF frequency F of the burst wave 213 input to the TANK circuit 206 are two frequencies: RF frequency F1 and RF frequency F2, and with the input of the RF frequency, the switches S1 and S2 are on-off controlled, whereby the resonance frequency of the TANK circuit 206 is varied to the resonance frequencies f1, f2.

Thus, the frequency input to the piezoelectric element 100 is varied. In other words, since the frequency for driving the piezoelectric element 100 is varied, the oscillation frequency of an ultrasonic wave output from the piezoelectric element 100 is changed with the variation to change the size of an ink drop discharged from an ink discharge opening 112. That is, ink drops with different diameters can be discharged.

Thus, plural resonance frequencies of the TANK circuit 206 can be used, allowing the gain to be kept from remarkably falling for the different RF frequencies, and thereby no-discharge of an ink drop can be prevented. Furthermore, the driving circuit can be reduced in size and cost by adopting the TANK circuit 206 and high speed and high image quality recording is enabled.

Figure 6:
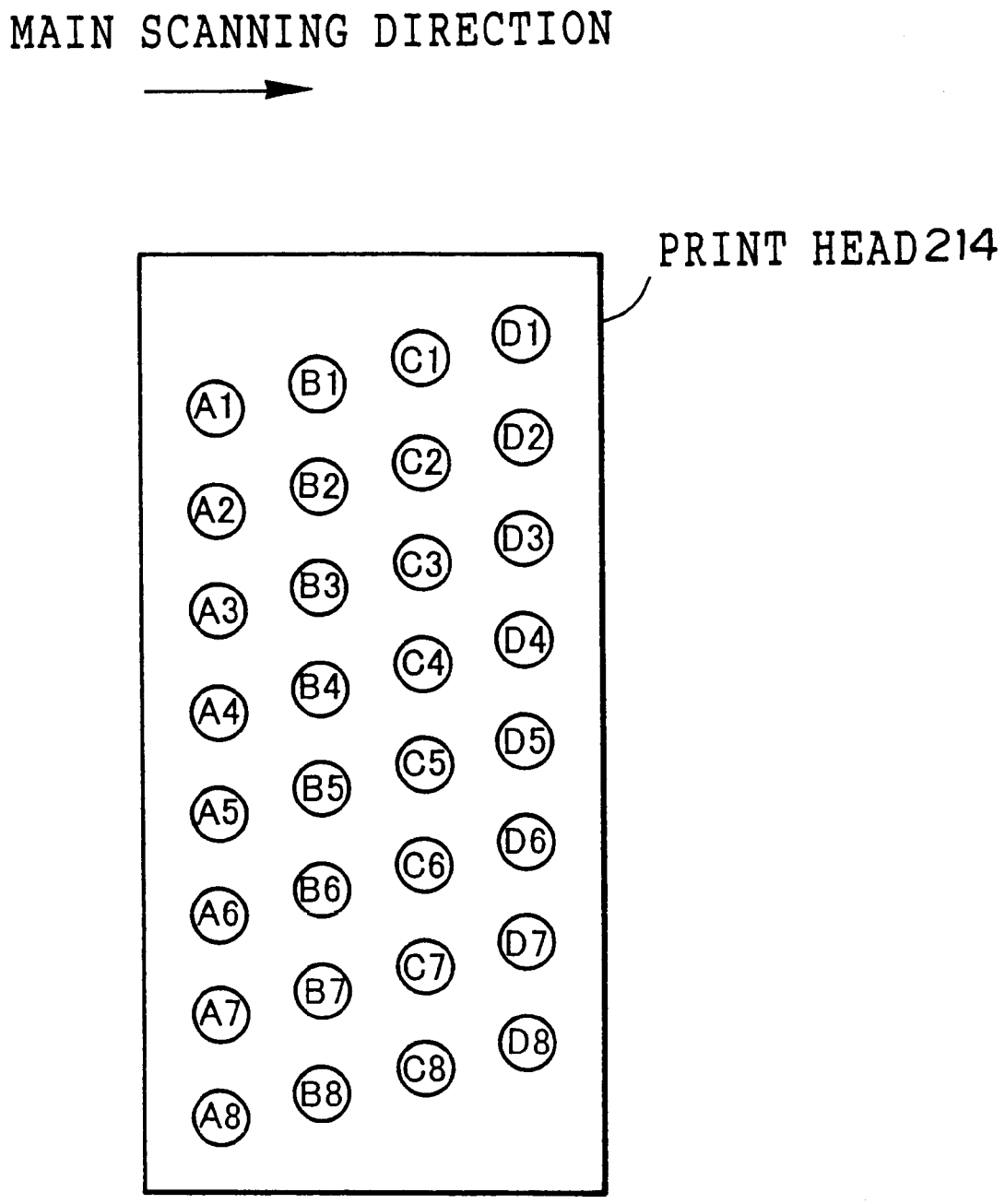
FIG. 6 is a diagram showing an example of a print head.

FIG. 6 shows an example of two-dimensional arrangement of an ejector constituting a print head 214. In the embodiment, the print head 214 is formed by thirty two ejectors arranged in two dimensions of 8×4. To simplify the following description, identifiers 1 to 8 are given in the row direction and identifiers A to D are given in the column direction to identify the respective ejectors by the identification numbers A1 to D8.

Since the array pitch of the ejectors is larger than the pixel pitch on the recording medium, image formation of one line is dispersed in the respective columns from the column A to the column D, and the respective columns are shifted from each other by the basic resolution, for example, 600 dpi.

Figure 7:
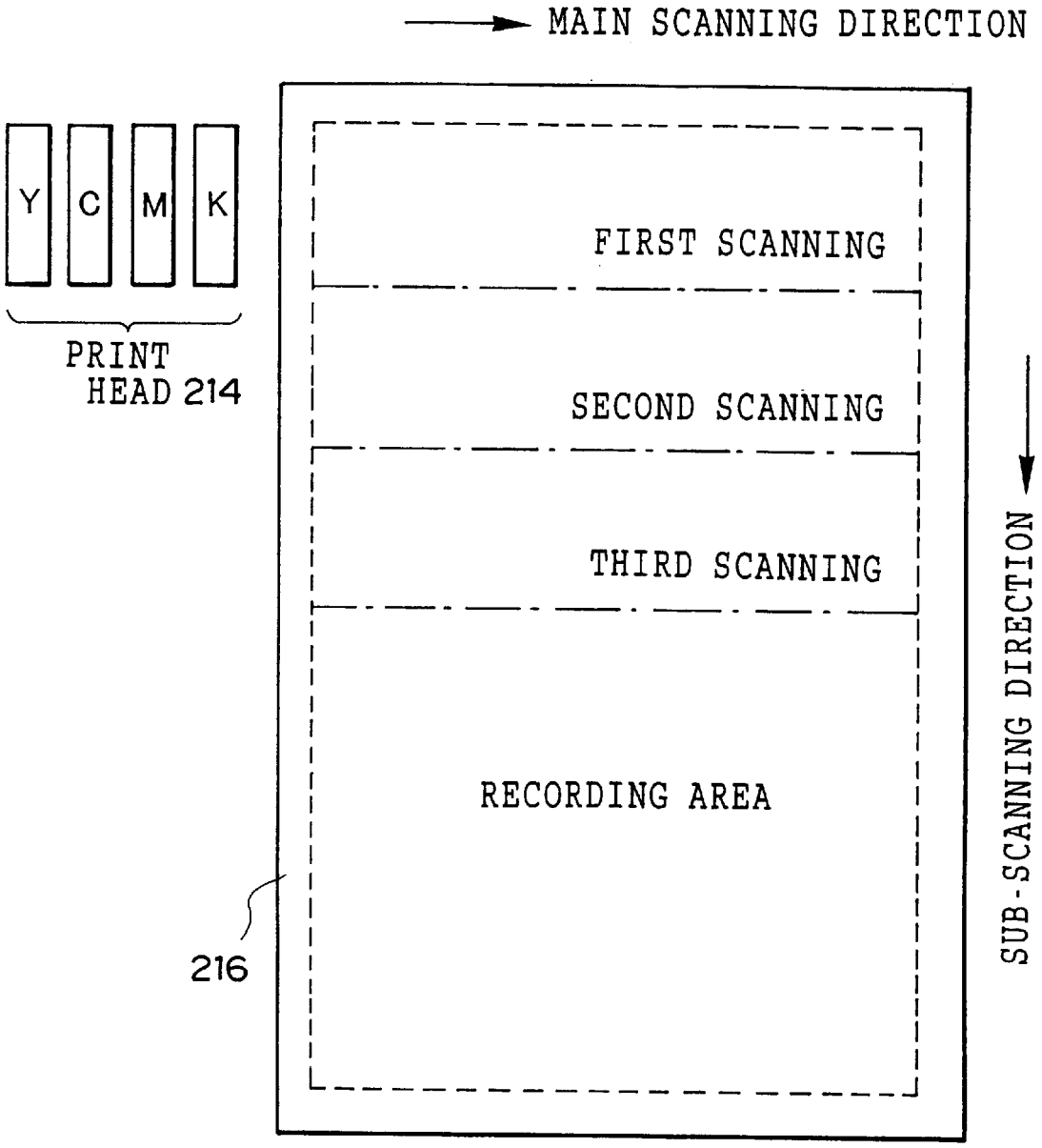
FIG. 7 is a diagram showing the relationship between the print head and the recording medium.

FIG. 7 shows the relationship between the print head 214 and the recording medium 216. The description of the embodiment deals with the case where there are four print heads 214 for discharging ink of four different colors, Cyan, Magenta, yellow and black. In the recording medium 216, a recording area for image formation is set. Each print head 214 is formed by plural ejectors arranged in two dimensions shown in FIG. 6. One pixel in the recording area is formed by one ejector, and on completion of driving all of ejectors (8×4=thirty two ejectors in this embodiment), the print head 214 is moved. This operation is repeated to form an image on the recording medium 216.

In this case, for each scanning direction, the transfer unit of the print head 214 takes the value equal to the numerical quantity for each scanning direction of the ejectors arranged in the print head 214 as a standard value. For example, in the ejector array of FIG. 6, the transfer unit in the main scanning direction corresponds to one ejector, and the transfer unit in the sub-scanning direction corresponds to eight ejectors. That is, as shown in FIG. 7, in the first scanning, the print heads 214 are moved in the main scanning direction on every completion of driving all ejectors, and after the main scanning is ended, the print heads 214 are moved in the sub-scanning direction to start the second scanning. The operation is repeated for the interior of the recording area to form an image. The relative positions of the print heads 214 is previously determined according to the transfer unit of the print head 214 in the image forming process so that the pixel position on the recording area should not be shifted.

Figure 8B:
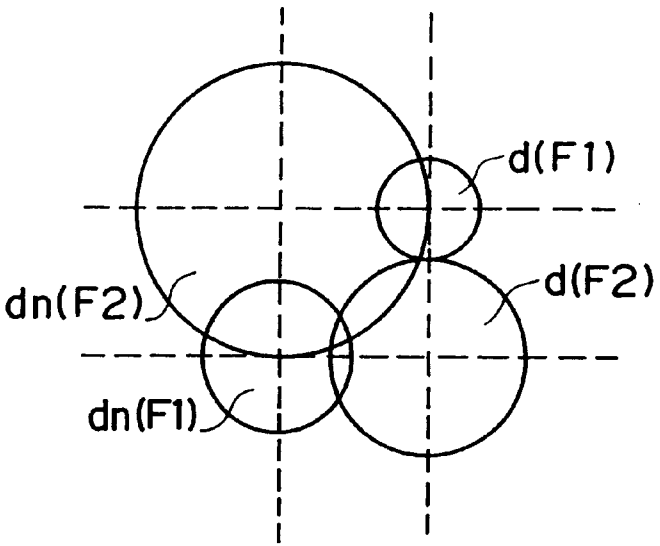
FIGS. 8A and 8B are diagrams showing an example of an image on the recording medium by recording modes.
Figure 8A:
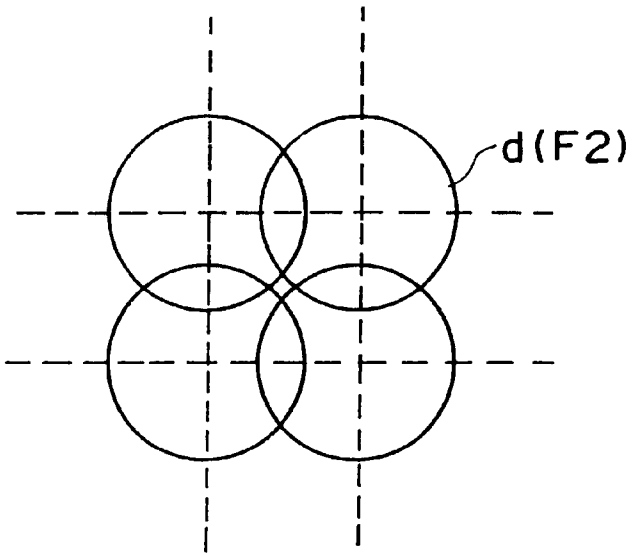

FIGS. 8A and 8B show an example of an image on the recording medium for the recording mode. FIG. 8A shows the case of high speed recording and FIG. 8B shows the case of high image quality recording. In the high speed recording mode, large-diameter ink drops are discharged from all of ejectors. That is, the ejector is driven by the RF signal having a low frequency component F2, thereby forming a large-diameter dot d(F2) in a designated position on the recording medium.

On the other hand, in the high image quality recording mode, an ink drop with the optimum diameter is discharged from each ejector. That is, dots with various diameters such as a small-diameter dot d(F1) by the RF signal having a high frequency component F1, a medium-diameter dot dn (F1) where the small-diameter dots d(F1) are superposed n-number of times, the large-diameter dot d(F2) and a very large dot dn (F2) where the large-diameter dots d(F2) are superposed n-number of times are formed in a designated position on the recording medium.

In the embodiment, in the inductance switching circuit 205, two inductances to be switched are provided, the number is not limited to two, but two or more, plural inductances may be provided. For example, three kinds of resonance frequencies can be obtained by providing three inductances. That is, three kinds of dot diameters can be used properly.

Though the inductance is switched by the inductance switching circuit 205 in the embodiment, in the TANK circuit formed by a resonance circuit comprising the capacity component of the piezoelectric element and the inductance connected in parallel to the piezoelectric element, the capacity component switching circuit for switching the capacity component may be provided. In this case, the resonance frequency can be switched by switching the capacity component.

Example

An example relating to the first embodiment will now be described in detail with reference to the attached drawings.

Figure 9:
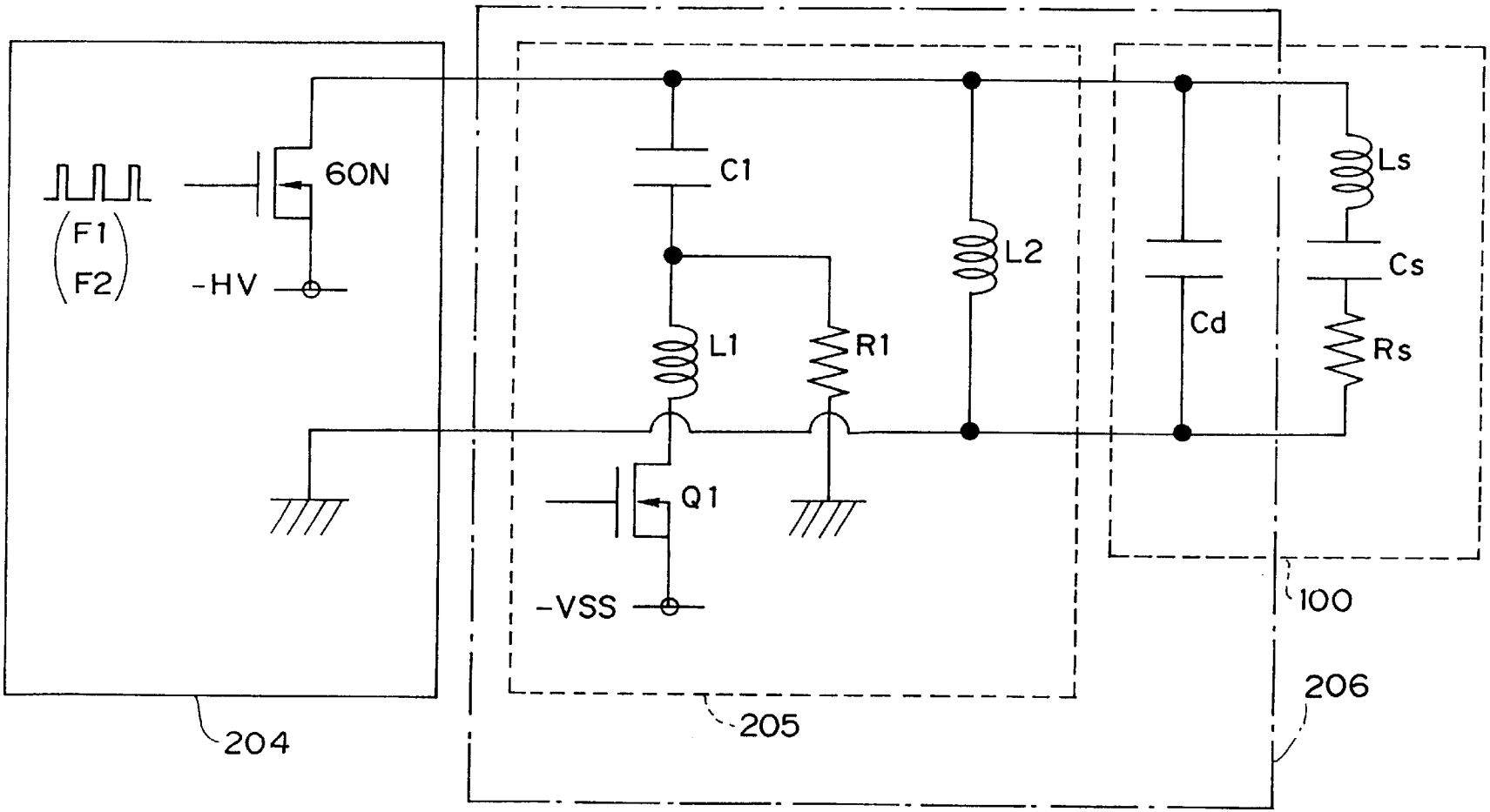
FIG. 9 is a conceptual view showing an example of a switch in an inductance switching circuit.

FIG. 9 shows an example of the switches S1 and S2 (see FIG. 1) in the inductance switching circuit 205 related to the first embodiment. The inductance switching circuit 205 includes an N-channel field effect transistor Q1 which switches in accordance with a control signal inputted to the gate. The source of the transistor Q1 is connected to a negative power source (−VSS), and an inductance L1 is connected to the drain of the transistor Q1. A resistor R1, one end of which is grounded, and a capacitor C1 are connected to the other end side of the inductance L1 . The capacitor C1 is connected to the amplifying part 204, and to an inductance L2 one end of which is grounded, and to a piezoelectric element 100. In this case, the inductor L2 is grounded to be always in the on-state, and only for the inductor L1 , an N-channel field effect transistor Q1 is used as a capacitive switch. In the case where the frequency of the RF signal is very high as much as 100 Mhz order, a current commercial transistor element is not capable of switching because the capacity component is too large. Accordingly, the source of the transistor Q1 is not grounded, but connected to a negative poser supply (−VISS) to lower the capacity component.

When the transistor Q1 is in the on-state, the d.c. current component flowing through the negative power supply is cut by the capacitor C1 and by-passed by a. resistor R1. The RF signal is by-passed by the C1 to hardly flow through the resistor R1. The capacitor C1 and the resistor R1 are selected to satisfy these conditions.

In the above structure, it is possible to switch the inductance by a control signal inputted to the gate of the N-channel field effect transistor Q5.

Figure 10:
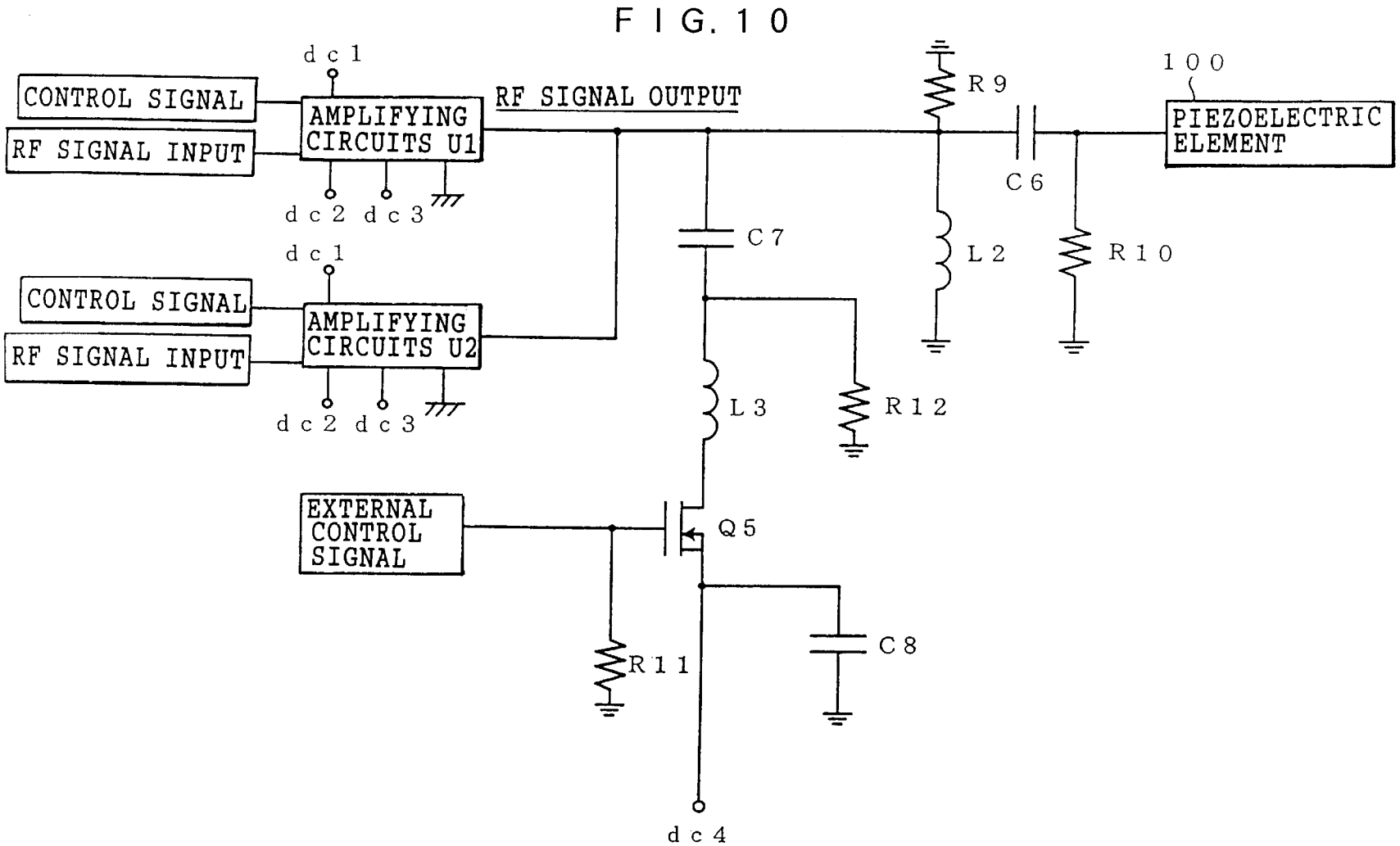
FIG. 10 is a conceptual view showing a first example of a driving circuit including an inductance circuit.

FIG. 10 shows an example of embodiment of a driving circuit including the inductance switching circuit 205 related to the first embodiment.

This driving circuit has amplification circuits U1 and U2. Each of the amplification circuits U1 and U2 is grounded, and d.c. power sources dc1, dc2, dc3, control signals, and RF signals are inputted thereto. The amplification circuits U1 and U2 are connected to a capacitor C7 (corresponding to the capacitor C1 in FIG. 9), a resistor R9 one end of which is grounded, an inductance L2 one end of which is grounded, and a capacitor C6. The capacitor C6 is connected to a resistor R10 one end of which is grounded, and to the piezoelectric element 100. Further, a resistor R12 (which corresponds to the resistor R1 in FIG. 9) one end of which is grounded, and an inductance L3 (corresponding to the inductance L1 in FIG. 9) are connected to the other end side of the capacitor C7. The inductance L3 is connected to the drain of the N-channel field effect transistor Q5 (corresponding to the transistor Q1 shown in FIG. 9). A resistor R 11, one end of which is grounded, is connected to the gate of the field effect transistor Q5, such that an external control signal is inputted thereto. A d.c. power source dc4 and a capacitor C8 one end of which is grounded are connected to the source of the field effect transistor Q5.

Namely, the outputs of two amplifying circuits U1 and U2 are connected to the TANK circuit including the inductance switching circuit. The amplifying circuits U1 and U2 are respectively designated to efficiently transmit the RF frequencies F1 and F2. In the case of driving the piezoelectric element with the RF frequency F1, a designated signal is inputted to pause the amplifying circuit U2 and apply an electric current only to the amplifying circuit U1, and also a signal for putting the switch Q5 of the inductance switching circuit in the on-state is inputted. In the case of driving the piezoelectric element with the RF frequency F2, a designated signal is inputted to pause the amplifying circuit U1 and apply an electric current only to the amplifying circuit U2, and also a signal for putting the switch Q5 of the inductance switching circuit in the off-state is inputted. Switching of the inductance is thereby made possible.

Figure 11:
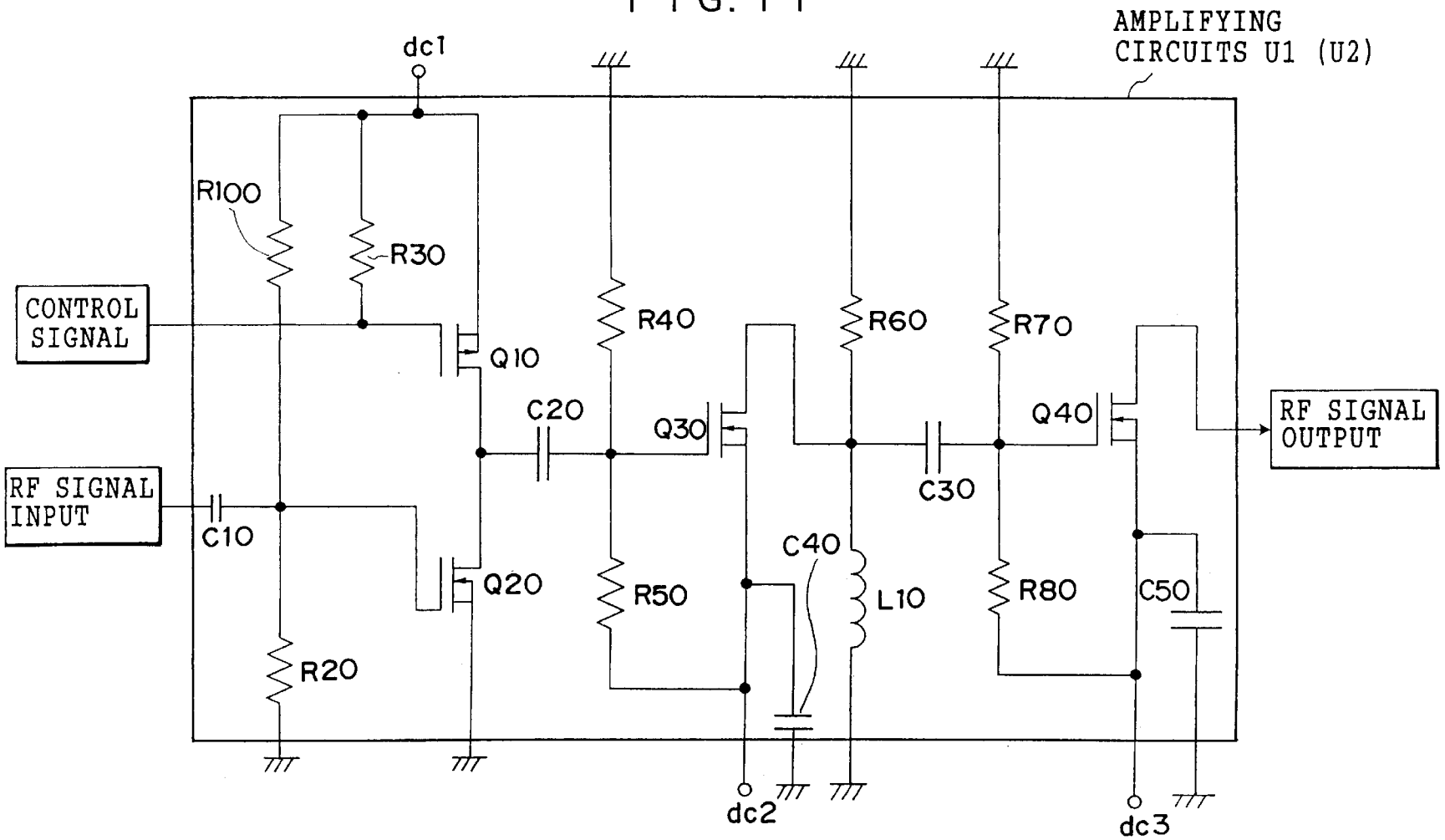
FIG. 11 is a conceptual view showing an example of details of an amplifying circuit in FIG. 10.

Further, FIG. 11 shows a detailed circuit configuration of the amplifying circuits U land U2 shown in FIG. 10. The amplifying circuits U1 and U2 have the same configuration, and the RF frequency band can be made different by the inductance L1.

The amplifying circuits U1 and U2 include field effect transistors Q10 and Q20. A control signal is inputted to the gate of a P-channel field effect transistor Q10. The RF signal is inputted to the gate of the N-channel field effect transistor Q2 via a capacitor C10. A resistor R30, which is connected to the d.c. power source dc1, is connected to the gate of the field effect transistor Q10. A resistor R20, one end of which is grounded, and a resistor R100, which is connected to the d.c. power source dc1, are connected to the gate of the field effect transistor Q20. Further, the d.c. power source dc1 is connected to the source of the field effect transistor Q10. The source of the field effect transistor Q20 is grounded. The drain of the field effect transistor Q10 and the drain of the field effect transistor Q20 are connected to the capacitor C20.

To the capacitor C20 are connected a resistor R40 one end of which is grounded, the gate of an N-channel field effect transistor Q30, and a resistor R50 connected to a d.c. power source dc2. The source of the field effect transistor Q30 is connected to a capacitor C40 one end of which is grounded and to the d.c. power source dc2. The drain of the field effect transistor Q3 is connected to a resistor R60 one end of which is grounded, an inductance L10 one end of which is grounded, and a capacitor C30.

A resistor R70 one end of which is grounded, the gate of an N-channel field effect transistor Q40, and a resistor R80 connected to a d.c. power source dc3 are connected to the capacitor C30. A capacitor C50, one end of which is grounded, is connected to the source of the field effect transistor Q40, and the RF signal is outputted from the drain of the field effect transistor Q40.

In accordance with the above-described structure, by setting the inductance L10 to a different value for each of the amplifying circuits U1 and U2, the RF frequencies efficiently passing through the amplifying circuits U1 and U2 can be made to be different. Namely, due to the inductance L10, the RF frequency bands can be made to be different.

Figure 12:
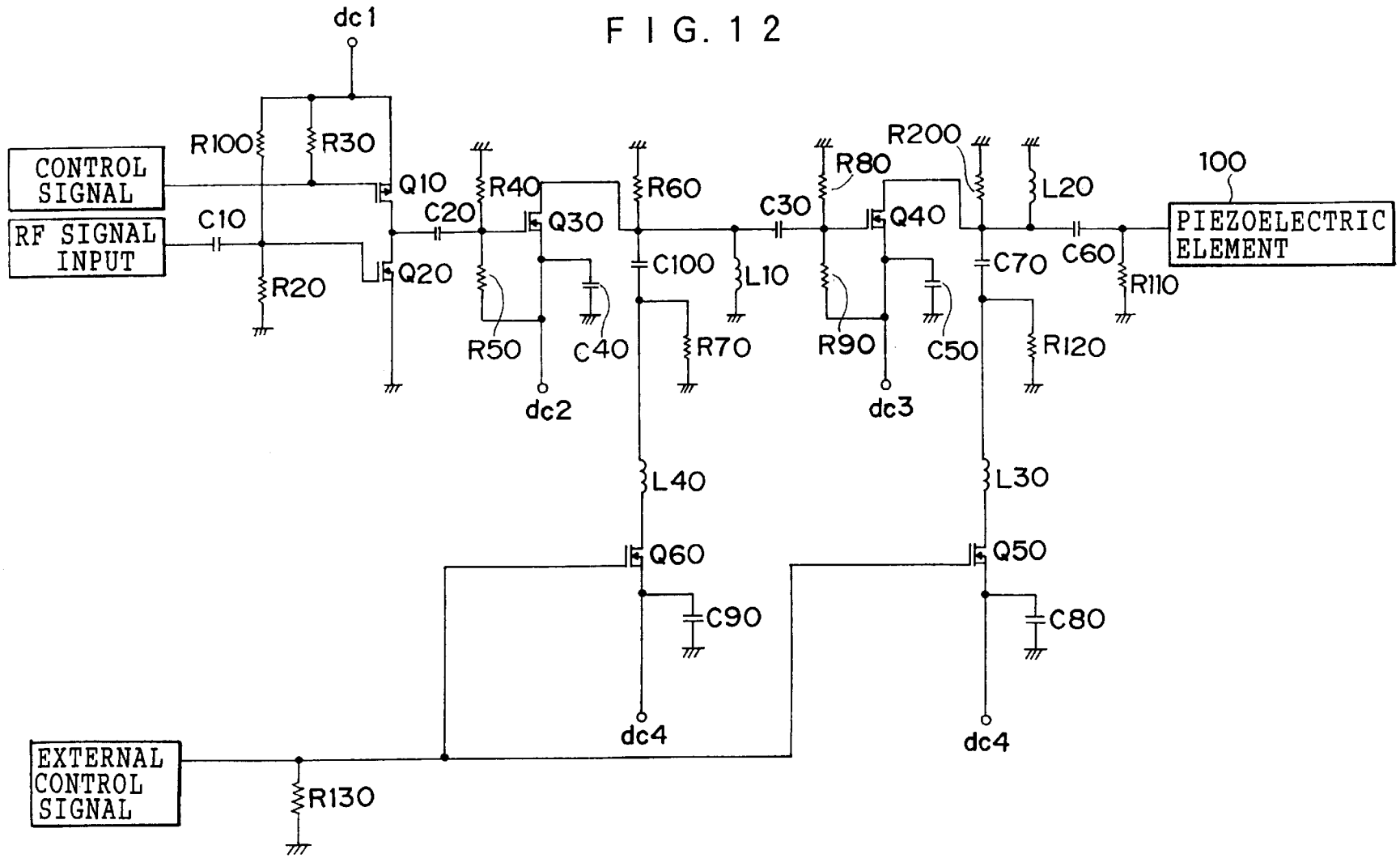
FIG. 12 is a conceptual view showing a second example of a driving circuit including an inductance switching circuit.

FIG. 12 is a second example of a driving circuit equipped with the inductance switching circuit.

In the driving circuit, a control signal is inputted to the gate of a P-channel field effect transistor Q10. The RF signal is inputted via the capacitor C10 to the gate of an N-channel field effect transistor Q20. The resistor R30, which is connected to the d.c. power source dc1, is also connected to the gate of the field effect transistor Q10. The resistor R20 one end of which is grounded, and the resistor R 100 connected to the d.c. power source dc1 are connected to the gate of the field effect transistor Q20. Further, the d.c. power source dc1 is connected to the source of the field effect transistor Q100. The source of the field effect transistor Q20 is grounded. The drain of the field effect transistor Q10 and the drain of the field effect transistor Q20 are connected to the capacitor C20.

The resistor R4 one end of which is grounded, the gate of the N-channel field effect transistor Q30, and the resistor R50 connected to the d.c. power source dc2 are connected to the capacitor C20. The source of the field effect transistor Q30 is connected to a capacitor C40 one end of which is grounded, and to a d.c. power source dc2. The drain of the field effect transistor Q30 is connected to a resistor R60 one end of which is grounded, an inductance L10 one end of which is grounded, and to a capacitor C30.

A capacitor C100 is connected to the drain of the field effect transistor Q30. A resistor R70 one end of which is grounded, and an inductance L40 connected to the drain of an N-channel field effect transistor Q60, are connected to the other end of the capacitor C100. To the gate of the field effect transistor Q60 are connected a resistor R130 one end of which is grounded, and an external control signal. A capacitor C90 one end of which is grounded and a d.c. power source dc4 are connected to the source of the field effect transistor Q60.

To the other end of the capacitor C30 are connected a resistor R80 one end of which is grounded, the gate of the N-channel field effect transistor Q40, and a resistor R90 connected to the d.c. power source dc3. A capacitor C50 one end of which is grounded, and the d.c. power source dc3 are connected to the source of the field effect transistor Q40. A resistor R200 one end of which is grounded, an inductance L20 one end of which is grounded, and capacitors C60, C70 are connected to the drain of the field effect transistor Q40. To the other end of the capacitor C70 are connected a resistor 120 one end of which is grounded, and an inductance L30 one end of which is connected to the drain of the N-channel field effect transistor Q50. Further, a capacitor C80 one end of which is grounded, and the d.c. power source dc4 are connected to the source of the field effect transistor Q50. A resistor R130 one end of which is grounded, is connected to the gate of the field effect transistor Q50 such that an external control signal is inputted.

A resistor R10 one end of which is grounded, and the piezoelectric element 100 are connected to the other end side of the capacitor C60.

The values of the circuit elements described above are set appropriately in accordance with the respective circuits.

In the driving circuit structured as described above, by controlling the field effect transistor Q50 as well as the field effect transistor Q60 in accordance with an external control signal, switching of the supplying of power to the inductance L30 is carried out, and by switching the supplying of power to the inductance L40, different RF frequency bands can be obtained. Namely, unlike the first example, the amplifying circuit is provided with an inductance switching circuit to make the amplifying circuit into one. The principle of operation is equal to the first example except that the amplifying circuit input is made common. Thus, the circuit scale can be remarkably reduced by integration of the amplifying circuit.

Figure 13:
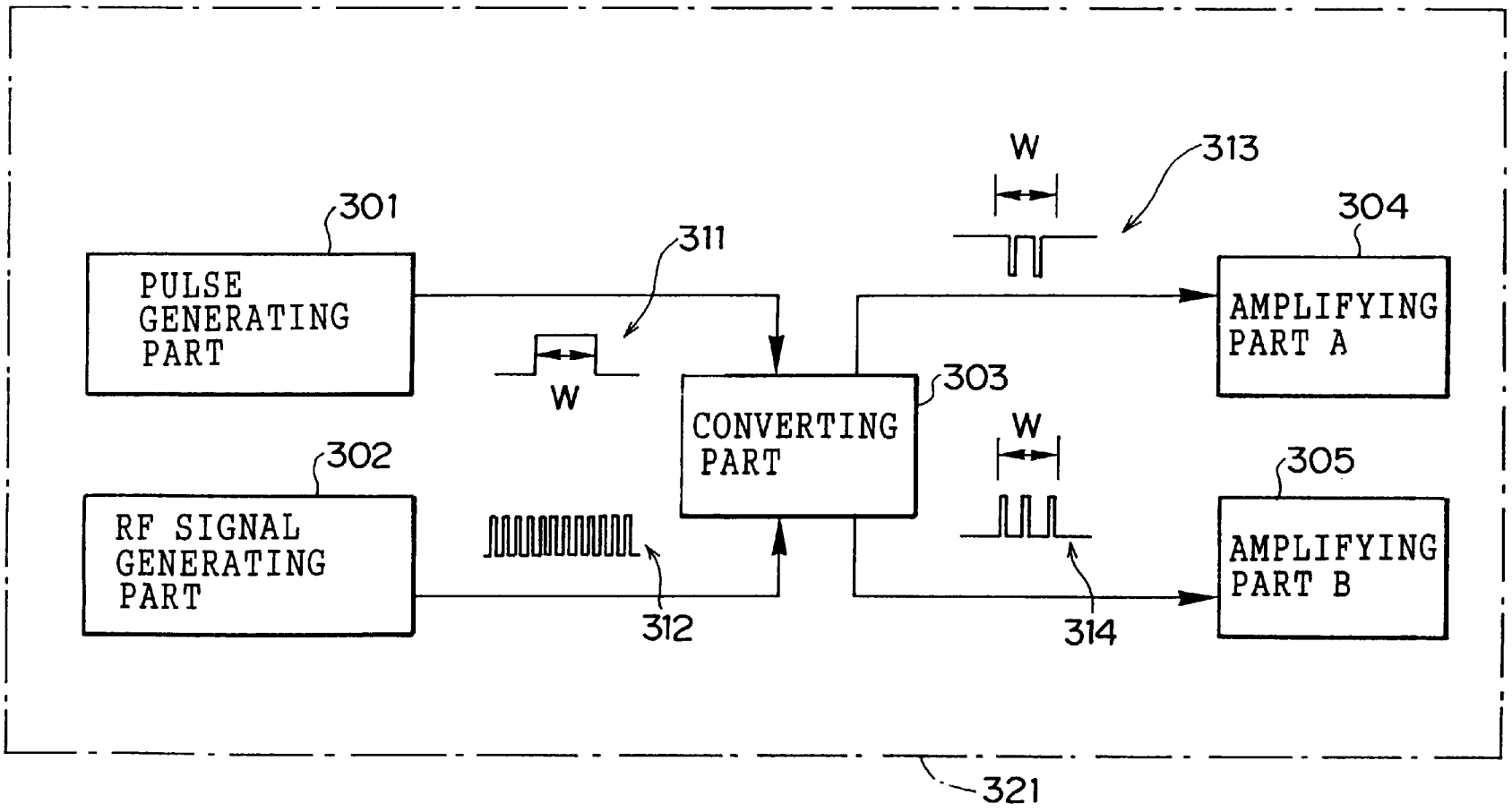
FIG. 13 is a schematic block diagram showing the configuration of a second embodiment of a driving circuit of the present invention.

Second Embodiment:

A second embodiment of a driving circuit will now be described in detail. FIG. 13 shows the internal configuration of a driving circuit 321 related to the second embodiment. As shown in FIG. 13, the driving circuit 321 includes a pulse generating part 301 for generating a designated pulse, an RF signal generating part 302 for generating a designated a.c. signal (RF signal), a pulse generating part 301, a converting part 303 for reversing the respective signals according to the signals from the pulse generating part 301 and the RF signal generating part 302 and converting the same to the RF pulse signal at a duty ratio of 25% with phase lag of π, and an amplifying part A304 and an amplifying part B305 for amplifying the respective signals output from the converting part 303, wherein a RF signal 312 with a designated frequency F generated by the RF signal generating part 302 and a pulse 311 with a designated pulse width W generated by the pulse generating part 301 are converted to two reversed RF pulse signals 313 and 314 at a duty ratio of 25% with a phase lag of π in the converting part 303. The converted RF pulse signals 313 and 314 both have a frequency component F equal to the RF signal 312 and both are burst wave of a length W. The RF pulse signal 313 is amplified in the amplifying part A 304 and the RF pulse signal 314 is amplified at the amplifying part B 305.

As described in the first embodiment, there is direct proportionality between the wavelength of an ultrasonic wave propagating through the ink chamber and the diameter of a discharged ink drop. Since the frequency of an ultrasonic wave converted by the piezoelectric element 100 is equal to the RF frequency F, the inverse proportional relationship is established between the RF frequency F and the wavelength of an ultrasonic wave. Accordingly, the RF frequency F is, as shown in FIG. 4, inversely proportional to the diameter D of the ink drop. For example, in FIG. 4, supposing that the relationship expressed by:

$$F2=(½)\times F1 \quad (1)$$

is established between two different RF frequencies F1 and F2, the relationship expressed by:

$$D2=2\times D1 \quad (2)$$

is established between the diameters D1 and D2 of ink drops corresponding thereto.

Further, it is known up to now that the relationship between the diameter D of a discharged ink drop and the dot diameter formed on the recording medium is experimentally direct proportionality. That is, in the expression (2), it means that supposing that an ink drop with a diameter D2 forms a dot with 600 dpi on the recording medium, a dot with 1200 dpi is formed on the recording medium by an ink drop with a diameter D1.

Further, it is confirmed by experiments up to now that the time required for a series of processes related to ink drop discharge, that is, meniscus generation, ink drop discharge and meniscus annihilation and the like can be controlled to be constant regardless of the diameter of the ink drop.

Thus, in the case where the diameter D of the ink drop discharged from the same ink discharge opening can be controlled by changing the RF frequency, the gradient of the acoustic printer can be secured while lowering of the print speed is restrained.

Figure 14:
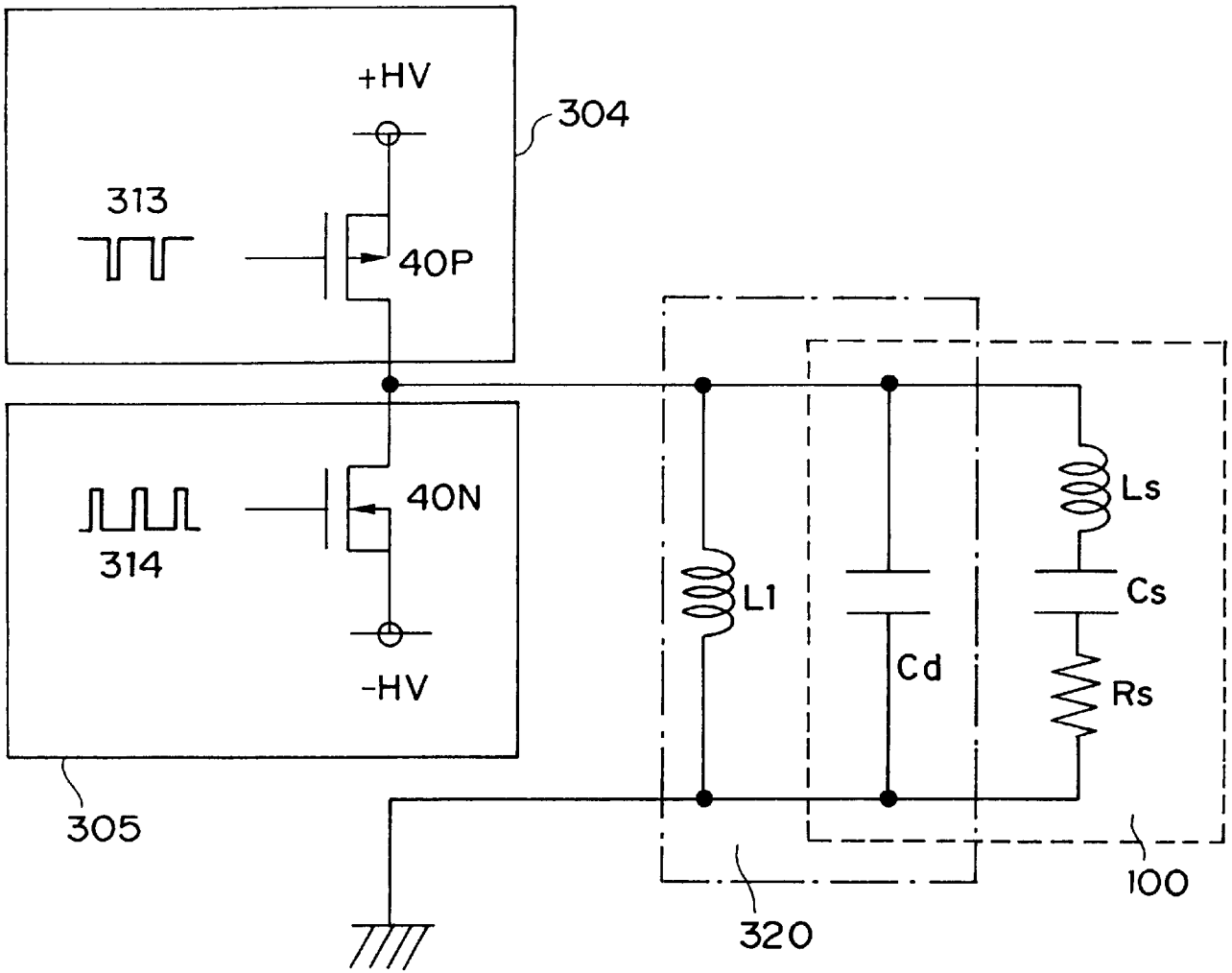
FIG. 14 is a conceptual view showing the configuration at the output stage of the second embodiment of the driving circuit.

Then, in the present embodiment, the vicinity of the output stage in the driving circuit 321 is constituted as shown in FIG. 14. FIG. 14 is a conceptual drawing of the vicinity of the output stage of the driving circuit 321 related to the second embodiment. In here, concerning the case of transmitting two different RF frequencies F1 and F2 to the piezoelectric element 100, the driving circuit 321 in the embodiment will now be described further in detail. In FIG. 14, the piezoelectric element 100 is shown as an equivalent circuit where a series resonance circuit of an inductance Ls, a capacitor Cs and a resistor Rs is connected in parallel to a capacitor Cd.

The output stage of the amplifying part A 304 is formed by a P-channel field effect transistor 40P in here, and the output stage of the amplifying part B 305 is formed by an N-channel field effect transistor 40N in here. The drains of the transistors 40P and 40N are connected to each other to form mutually complementary amplifying circuits. An inductance L1 connected in parallel to the electrostatic capacity Cd included in the piezoelectric element 100 is further connected to the respective drains of the transistors 40P and 40N. The inductance L1 and the electrostatic capacity Cd form a parallel resonance circuit called TANK circuit 320. That is, the TANK circuit 320 has a single resonance frequency f expressed by:

$$f=1/\{2\pi\sqrt{(L1\times Cd)}\} \quad (3).$$

The operation of a second embodiment of the thus constructed driving circuit 321 will now be described in accordance with FIGS. 13 and 14.

A pulse 301 with a designated pulse width W is generated by the pulse generating part 301. The RF signal 312 is generated in the RF signal generating part 302. The pulse 301 and the RF signal 302 are respectively input to the converting part 303. In the converting part 303, the pulse and the signal are converted to two inverted RF pulse signals 313 and 314 with a phase shift π and at a duty ratio of 25%. Two RF pulse signals 313 and 314 are respectively amplified by the amplifying part A304 and the amplifying part B305 to be input to the TANK circuit 320.

The input of RF pulse signals 313 and 314 input to the TANK circuit 320 to the respective gates of a P-channel field effect transistor 40P in the amplifying part A303 or an N-channel field effect transistor 40N in the amplifying part B305 is externally controlled to control the output of the RF pulse signals 313, 314 to the TANK circuit 320.

Figure 15B:
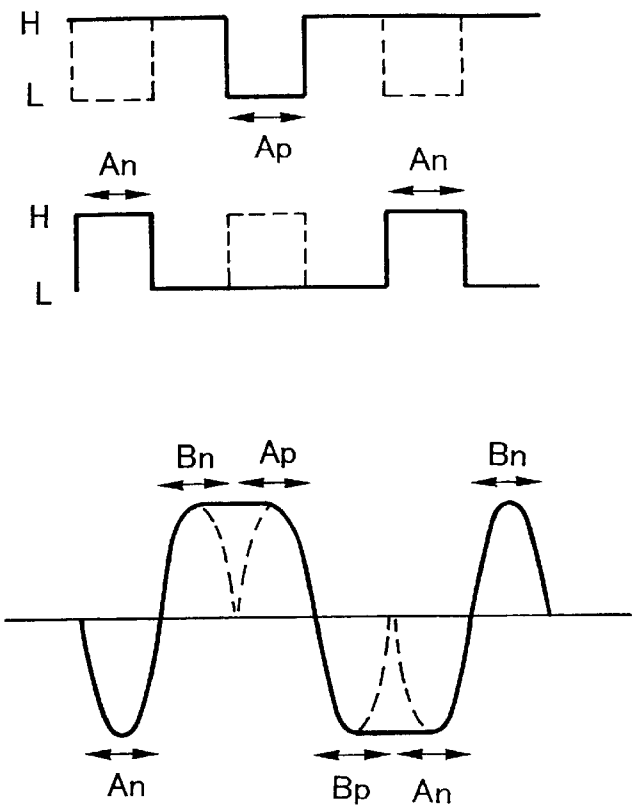
FIGS. 15A and 15B are diagrams for explaining an example of generating RF signals having different frequency components.
Figure 15A:
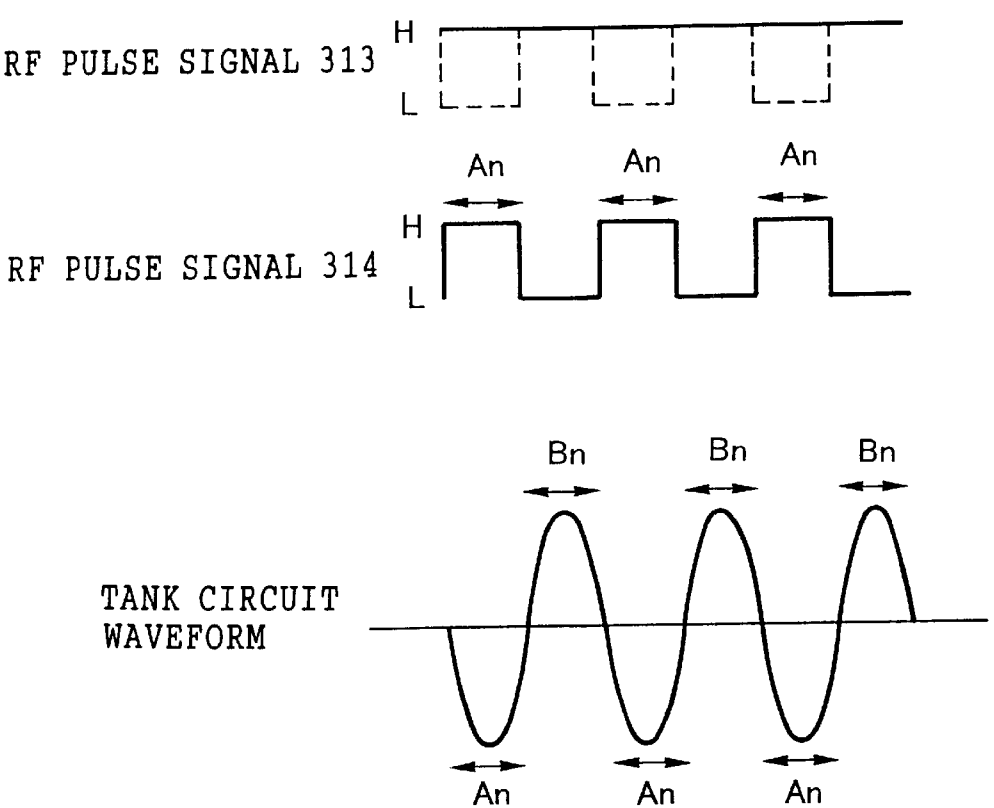

FIGS. 15A and 15B explain RF signal generation having different frequency components. FIG. 15A shows the case of the frequency component F1, and FIG. 15B shows the case of the frequency component F2. In the diagrams, An is a forced vibration period by the transistor 40N, Bn is a free vibration period by the same, Ap is a forced vibration period by the transistor 40P, and Bp is a free vibration period by the same.

For example, in the case of generating a small diameter ink drop, as shown in FIG. 15B, the RF pulse signal 313 causes the amplifying part A304 to be in the rest. That is, to put the transistor 40P always in the off-state, always H-level is kept and the RF pulse signal 314 is a pulse signal having a frequency component F1 equal to the resonance frequency (f) of the TANK circuit. As a result, the TANK circuit waveform is, as described in Japanese Patent Application Laid Open No. 11-072211 already proposed by the applicant of the invention, a sinusoidal burst wave having a frequency component F1 where the forced vibration period An and the free vibration period Bn are repeated.

In the case of generating a large diameter ink drop, as shown in FIG. 15B, the RF pulse signals 313 and 314 are such that the duty ratio is 25% which is half the ratio designated in FIG. 15A and the pulse width is fixed to be equal to that of FIG. 15A. The RF pulse signal 313 is logically-inverted and phase-shifted by π to the RF pulse signal 314. As compared with the case of FIG. 15A, the pulse period is double, but the pulse width itself is equal, so that the RF pulse signals 313, 314 have a frequency component F1 equal to the resonance frequency (f) of the TANK circuit. Accordingly, the RF pulse signals 313, 314 are passed with the gain equal to that in the case of FIG. 15A through the TANK circuit 320 and transmitted to the piezoelectric element 100. Consequently, the free vibration period Bn by the transistor 40N and the forced vibration period Ap by the transistor 40P are of the same polarity, and the free vibration period Bp by the transistor 40P and the forced vibration period An by the transistor 40N are of the same polarity. At this time, in the TANK circuit 320, a signal waveform enveloping the above as indicated by a solid line in FIGS. 15A and 15B is formed. That is, not being sinusoidal, $$F2=\tfrac{1}{2}\times F1 \tag{4}$$

a burst wave having a frequency component F2 satisfying the above equation (4) is obtained.

Accordingly, the frequency input to the piezoelectric element 100 is varied. In other words, as the frequency of driving the piezoelectric element 100 is varied, the vibration frequency of ultrasonic waves output from the piezoelectric element 100 is changed with the variation so that the size of an ink drop discharged from the ink discharge opening 112 is changed. That is, ink drops different in diameter can be discharged.

Though in the second embodiment, the resonance frequency of the TANK circuit 320 is single in the second embodiment, RF signals having different frequency components can be generated by providing the amplifying part A304 and the amplifying part B305. Since the frequency input to the piezoelectric element 100 is varied as described above, gain is kept from being remarkably lowered for the different RF frequencies so as to prevent non-discharge of an ink drop. By using the TANK circuit 206, the driving circuit can be reduced in size and cost and high speed and high image quality recording is enabled.

An example of two-dimensional arrangement of ejectors constituting the print head is, as shown in FIG. 6, can be the same as that of the first embodiment. Also in the second embodiment, the print head 214 can be formed by thirty two ejectors arranged in two dimensions with 8 by 4. To simplify the following description, the identifiers 1~8 are given in the direction of row and the identifiers A~D are given in the direction of column to identify the respective ejectors by the identification numbers A1~D8.

The array pitch of the ejectors is larger than the pixel pitch on the recording medium, so that the image formation for one line is distributed to the respective columns A to D, and the respective columns are shifted for the basic resolution, for example, by 600 dpi.

The relationship between the print head 214 and the recording medium 216 is as shown in FIG. 7 similarly to the first embodiment. Also in the second embodiment, the description deal with the case where four print heads 214 are provided to discharge ink of four different colors such as Cyan, Magenta, yellow and black. A recording area for image formation is fixed n the recording medium 216. Each print head 214 is formed by a plurality of ejectors arranged in two dimensions. One pixel in the recording area is formed by one ejector, and on the completion of driving all ejectors (in the embodiment, 8×4=32), the print heads 214 are moved. An image is formed on the recording medium 216 by repeating the above operation.

In this case, the transfer unit of the print head 214 for the respective scanning directions takes a value equal to the numerical quantity to the respective scanning directions of the ejectors arranged on the print head 216 as a standard value. For example, in the ejector array of FIG. 6, the transfer unit in the main scanning direction is a value for one ejector, and in the sub-scanning direction is a value for eight ejectors. That is, as shown in FIG. 7, at the first scanning, on every completion of driving all ejectors, the print heads 214 are moved in the main scanning direction, after the end of main scanning direction, the print heads 214 are moved in the sub-scanning direction to start the second scanning. The operation is repeated for the interior of the recording area to form an image. The relative positions of the print heads 214 is previously determined according to the transfer units of the print heads 214 in the image forming process so that the pixel positions on the recording areas are not shifted.

An example of an image on the recording medium for the recording mode is as shown in FIGS. 8A and 8B similarly to the first embodiment. FIG. 8A shows the case of high speed recording, and FIG. 8A shows the case of high image quality recording. In the high speed recording mode, large diameter ink drops are discharged from all ejectors. That is, the ejectors are driven by the RF signal having a low frequency component F2, thereby forming a large-diameter dot (F2) in a designated position on the recording medium.

On the other hand, in the high image quality recording mode, an ink drop with the optimum diameter is discharged from each ejectors. That is, dots having various diameters such as a small diameter dot (d) by the RF signal having a high frequency component F1, a medium diameter dot dn(F1) where the small diameter dot d(F1) is superposed n-times, a large diameter dot d(F2) and a maximum diameter dot dn(F2) where the large diameter dot d(F2) is superposed n-times are formed in designated positions on the recording medium.

Example

An example relating to the second embodiment will now be described in detail with reference to the attached drawings.

Figure 16:
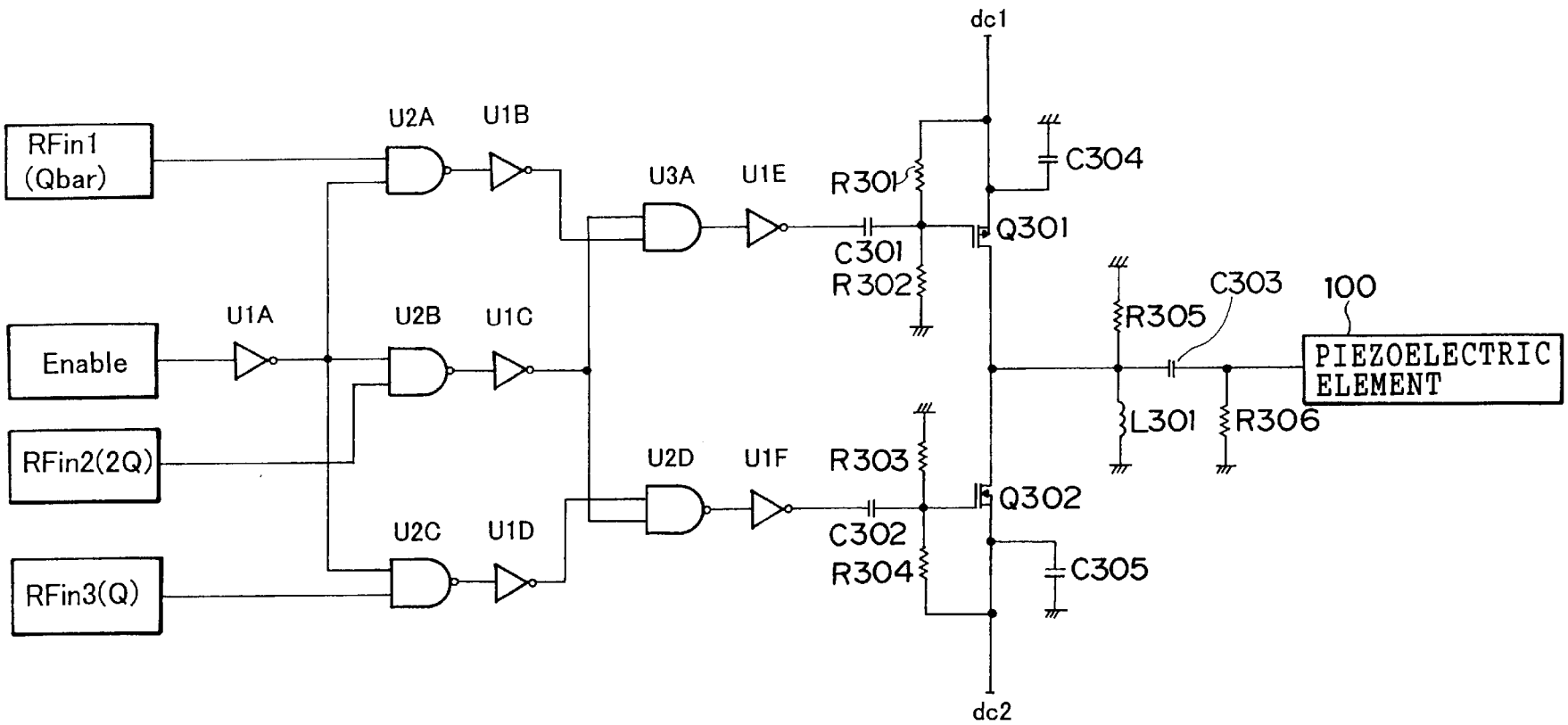
FIG. 16 is a conceptual view showing an example of the driving circuit in the second embodiment.

FIG. 16 shows an example of a driving circuit having a complementary amplifying circuit related to the second embodiment. The converting part 303 is formed by a digital circuit prior to the final stage transistors Q301 and Q302 of the amplifying part. The digital circuit includes RF signal input terminals RFin1 (Qbar), RFin2 (2Q) and RFin3 (Q), and input terminal Enable. The input terminal Enable is connected to an inverter U1A. The output of the inverter U1A is connected to NAND circuits U2A, U2 and U2C. To the input of the NAND circuit U2A is connected the RF signal input terminal RFin1, to the input of the NAND circuit U2A is connected the RF signal input terminal RFin2, and to the input of the NAND circuit U2C is connected the RF signal input terminal RFin3. The outputs of the NAND circuits U2A, U2B and U2C are connected to inverters U1B, U1C and U1D, respectively. The output of the inverter U1B is connected to the AND circuit U3A, the output of the inverter U1C is connected to the AND circuits U3A and U2D, and the output of the inverter U1D is connected to the NAND circuit U2D. The output of the AND circuit U3A is connected to the inverter U1E, and the output of the inverter U1E is inputted to the gate of the P-channel field effect transistor Q301 via the capacitor C301. The output of the NAND circuit U2D is connected to the inverter U1F, and the output of the inverter U1F is inputted to the gate of the N-channel field effect transistor Q302 via the capacitor C302.

The source of the transistor Q301 is connected to the positive power source dc1, and the source of the transistor Q302 is connected to the negative power source dc2.

The resistor R301 connected to the positive power source dc1 and the resistor R302 one end of which is grounded are connected to the gate of the field effect transistor Q301. A capacitor C304, one end of which is grounded, is connected to the source of the field transistor Q301. Further, a resistor R303 one end of which is grounded, and a resistor R304 connected to the negative power source dc2 are connected to the gate of the field effect transistor Q302. A capacitor C305, one end of which is grounded, is connected to the source of the field effect transistor Q302. The drain of the field effect transistor Q301 and the drain of the field effect transistor Q302 are connected to the resistor R305 one end of which is grounded, to the inductance L301 one end of which is grounded, and to the capacitor C303. The capacitor C303 is connected to the resistor R306 one end of which is grounded, and to the piezoelectric element 100. Note that, although some portions are denoted by the same reference numerals in the drawings, the same portions do not have to be denoted by the same numerals.

Three RF signal input terminals RFin1(Qbar), Rfin2 (2Q) and RFin3(Q) may be connected to one element, for example, in the case of using PLL (Phase Lock Loop) element. The input terminal Enable is connected to an external control circuit, and an input signal controls the duration of a burst wave. In the digital circuit of the converting part 303, an inverter element having an identifier starting with U1 desirably has a signal amplifying function in addition to logical inversion.

Table 1 shows the truth value table of input signals required for generating an RF signal having a desired frequency component.

TABLE 1

| Frequency | Input Terminal | | | |
|---|---|---|---|---|
| Component | RFin1 (Qbar) | Rfin2 (2Q) | RFin3 (Q) | Enable |
| F1 | Low | 2Q (=F1) | 2Q (=F1) | Low |
| F2 | Qbar (=F2) | 2Q (=F1) | Q (=F1) | Low |

For example, in the case of obtaining a frequency component F1 equal to the resonance frequency of the TANK circuit, RFin1 (Qbar) is always at L-level, and the output of the inverter element U1B is always at L-level, so that the output of the inverter element U1E is always at H-level. Accordingly, the transistor Q301 is always in off-state. On the other hand, RFin2(2Q) and RFin3(Q) are both 2Q, and the inputs of the NAND elements U2D are equal to each other so that the output of the inserter element U1F is equal to the input signal 2Q. Accordingly, only the transistor Q301 is turned on and off by the signal 2Q having the frequency component F1. That is, the TANK circuit waveform of FIG. 15A is input to the piezoelectric element 100 to discharge a small diameter ink drop.

In the case of obtaining the frequency component F2 satisfying the equation (4), though RFin2(2Q) is 2Q, RFin3 (Q) is Q divided into the half of the frequency, and RFin1 (Qbar) is Qbar obtained by logical inverting Q. The output of the AND element U3A and the output of the NAND element U2D are logical-inverted RF pulse signals with a phase shift by $\pi$ and at duty ratio of 25%. According to the RF pulse signals, the transistors Q301, Q302 are turned on and off. That is, the TANK circuit waveform of FIG. 15B is input to the piezoelectric element 100 to discharge a large diameter ink drop. Effect of the Invention:

According to the invention, as described above, it is possible to provide a driving circuit for an acoustic printer and an acoustic printer which enables high speed and high image quality recording and is reduced in size and cost by setting one inductance among a plurality of predetermined inductances connected in parallel to the piezoelectric element.

Furthermore it is possible to provide a driving circuit for an acoustic printer and an acoustic printer which enables high speed and high image quality by selectively composing a positive polarity pulse signal and a negative polarity pulse signal complementary with the positive polarity pulse signal and supplying the composite signal to the piezoelectric element.

What is claimed is:

1. A driving circuit for an acoustic printer to form an image on a recording medium by an ejector for discharging stored ink by an ultrasonic wave generated by a piezoelectric element according to the supply of an a.c. signal, comprising:

a resonance circuit including an inductance connected in parallel to said piezoelectric element, having a plurality of resonance frequencies, and being set to one resonance frequency among said plural resonance frequencies; and means for setting the resonance frequency of said resonance circuit, wherein at least one resonance frequency of the plurality of resonance frequencies is a frequency lower than a self-resonance frequency of said piezoelectric element.

2. A driving circuit for an acoustic printer according to claim 1, wherein said resonance circuit includes inductance means which can be set to one inductance among a plurality of predetermined inductances, and said setting means is adapted to set the resonance frequency by setting the inductance of said inductance means.

3. A driving circuit for an acoustic printer according to claim 1, wherein said setting means is adapted to set said plural resonance frequencies according to image data expressing an image formed on said recording medium.

4. A driving circuit for an acoustic printer to form an image on a recording medium by an ejector for discharging stored ink by an ultrasonic wave generated from a piezoelectric element, comprising:

generating means for generating a positive polarity pulse with a designated frequency for generating an a.c. signal supplied to said piezoelectric element and a negative polarity pulse signal complementary with said positive polarity pulse signal;

selecting means for selecting at least one of said positive polarity pulse signal and said negative polarity pulse signal; and a.c. signal generating means for generating an a.c. signal to be supplied to said piezoelectric element according to a pulse signal selected by said selecting means.

5. A driving circuit for an acoustic printer according to claim 4, wherein said selecting means is adapted to perform said selection according to image data expressing an image formed on a recording medium.

6. An acoustic printer including a driving circuit to form an image on a recording medium by an ejector for discharging stored ink by an ultrasonic wave generated by a piezoelectric element according to the supply of an a.c. signal, the driving circuit comprising:

a resonance circuit including an inductance connected in parallel to said piezoelectric element, having a plurality of resonance frequencies, and being set to one resonance frequency among said plural resonance frequencies; and means for setting the resonance frequency of said resonance circuit, wherein at least one resonance frequency of the plurality of resonance frequencies is a frequency lower than a self-resonance frequency of said piezoelectric element.

7. An acoustic printer including a driving circuit to form an image on a recording medium by an ejector for discharging stored ink by an ultrasonic wave generated from a piezoelectric element, the driving circuit comprising:

generating means for generating a positive polarity pulse with a designated frequency for generating an a.c. signal supplied to said piezoelectric element and a negative polarity pulse signal complementary with said positive polarity pulse signal;

selecting means for selecting at least one of said positive polarity pulse signal and said negative polarity pulse signal; and a.c. signal generating means for generating an a.c. signal to be supplied to said piezoelectric element according to a pulse signal selected by said selecting means.

8. A driving circuit for an acoustic printer to form an image on a recording medium by an ejector for discharging stored ink by an ultrasonic wave generated by a piezoelectric element according to the supply of an a.c. signal, comprising:

a resonance circuit including an inductance connected in parallel to said piezoelectric element, having a plurality of resonance frequencies, and being set to one resonance frequency among said plural resonance frequencies; and means for setting the resonance frequency of said resonance circuit, wherein said resonance circuit includes inductance means which can be set to one inductance among a plurality of inductances, and said setting means is adapted to set the resonance frequency by setting the inductance of said inductance means.

9. An acoustic printer including a driving circuit to form an image on a recording medium by an ejector for discharging stored ink by an ultrasonic wave generated by a piezoelectric element according to the supply of an a.c. signal, the driving circuit comprising:

a resonance circuit including an inductance connected in parallel to said piezoelectric element, having a plurality of resonance frequencies, and being set to one resonance frequency among said plural resonance frequencies; and means for setting the resonance frequency of said resonance circuit, wherein said resonance circuit includes inductance means which can be set to one inductance among a plurality of inductances, and said setting means is adapted to set the resonance frequency by setting the inductance of said inductance means.

* * * * *